US006743003B2

(12) United States Patent
Dong

(10) Patent No.: US 6,743,003 B2
(45) Date of Patent: Jun. 1, 2004

(54) HYDRAULIC DEVICE WITH BALANCED ROTOR

(75) Inventor: Xingen Dong, Greeneville, TN (US)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

(21) Appl. No.: 10/426,079

(22) Filed: Apr. 29, 2003

(65) Prior Publication Data

US 2004/0052667 A1 Mar. 18, 2004

Related U.S. Application Data

(60) Provisional application No. 60/410,680, filed on Sep. 13, 2002.

(51) Int. Cl.[7] ..... F01C 1/10
(52) U.S. Cl. ..... 418/61.3; 418/186
(58) Field of Search ..... 418/61.3, 186

(56) References Cited

U.S. PATENT DOCUMENTS 2,989,951 A * 6/1961 Charlson ..... 418/61.3
3,233,524 A * 2/1966 Charlson ..... 418/61.3
4,264,288 A 4/1981 Wiisthof et al. ..... 418/61.3
4,411,606 A * 10/1983 Miller ..... 418/61.3
4,717,320 A 1/1988 White, Jr. ..... 418/61.3
5,624,248 A 4/1997 Kassen et al. ..... 418/61.3

* cited by examiner

*Primary Examiner*—John J. Vrablik
(74) *Attorney, Agent, or Firm*—Joseph J. Pophal

(57) ABSTRACT

A rotary fluid pressure device having a housing member, a manifold assembly, a gerotor set, an end plate, and a rotatably journaled torque transfer shaft interconnected with the gerotor set and extending within the housing member and manifold assembly. The gerotor set having an internally toothed stator member and a rotating rotor member disposed within the stator member. The rotor member having a first and second axial end surface and external teeth which interengage with the internal teeth of the stator to define a plurality of expanding and contracting volume chambers. The rotor member also having a first plurality of circumferentially spaced laterally directed fluid paths which extend through the rotor for fluid connection between the manifold assembly and the volume chambers, and a second plurality of circumferentially spaced, laterally directed fluid paths interposed between the first plurality of fluid paths for sequentially channeling fluid between both axial end surfaces.

27 Claims, 13 Drawing Sheets

HYDRAULIC DEVICE WITH BALANCED ROTOR

CROSS-REFERENCE TO RELATED CASES

The present application claims the benefit of the filing date of U.S. Provisional Application Serial No. 60/410,680 filed Sep. 13, 2002.

FIELD OF THE INVENTION

The present invention relates to a rotary fluid pressure device, and more particularly to a gerotor motor wherein a gerotor set has an externally toothed, balanced rotor member with a first plurality of circumferentially spaced laterally directed fluid paths extending through the rotor and a second plurality of fluid paths being circumferentially interposed between the first plurality of fluid paths for sequentially channeling fluid between one of the first and second axial end faces.

BACKGROUND OF THE INVENTION

One type of rotary fluid pressure devices is generally referred to as gerotors, gerotor type motors, and gerotor type pumps, hereinafter referred to as gerotor motors. Gerotor motors are compact in size, low in manufacturing cost, have a high-torque capacity ideally suited for such applications as turf equipment, agriculture and forestry machinery, mining and construction equipment, as well as winches, etc. Gerotor motors have gerotor sets which utilize a special form of internal gear transmission consisting of two main elements: an inner rotor and an outer stator.

The inner rotor and the outer stator possess different centers. The inner rotor has a plurality of external teeth which contact circular arcs on the interior of the outer stator when it revolves. An output shaft is either directly connected to the orbiting inner rotor or is connected thereto by a drive link splined at each end. When pressurized fluid flows into a motor, the resistance of an external torsional load on the motor begins to build differential pressure, which in turn causes the inner rotor to rotate in the desired direction via a timing valve. Gerotor motors are typically manufactured in two forms, an internally generated rotor (hereinafter referred to as "IGR") gerotor set or an externally generated rotor (hereinafter referred to as "EGR") gerotor set. The outer stator of both IGR and EGR gerotor sets have one more tooth (N+1 teeth) than the inner rotor (N teeth). When the inner rotor rotates, it also orbits in the opposite direction of rotation with the speed of N times its own rotation.

Due to the flow of pressurized fluid through the gerotor sets, namely into and out of the volume chambers in the gerotor set, the inner rotor tends to have an imbalance of forces acting upon it. This imbalance of forces causes the rotor to tilt to one side during its rotation, resulting in unwanted wear along the surface of the rotor that comes in contact with an adjacent component, e.g. an end cap. Prior art constructions, such as those set forth in U.S. Pat. No. 5,624,248 to Kassen et al. have used an adjacent component, such as a plate, in order to balance the rotor that is tipping in one direction. The plate has hydraulic forces acting on one side, causing it to flex and come in physical contact with the rotor. This contact offsets the differential of forces which tip the rotor, allowing the rotor to rotate uniformly. The present invention uses hydraulically pressurized fluid to balance the rotor without having an extra component that physically contacts the rotor.

Other prior art constructions, such as those set forth in U.S. Pat. No. 4,264,288 to Wüsthof et al., provide opened/recessed slots on both sides of the hydraulic rotor for balance. This causes the rotor to remain axially aligned within the outer stator during its operation. The present invention differs from this prior art construction by providing two sets of axial through holes for balancing. One set of through holes transfers high pressure fluid, while the other set (which alternates between the first set) of through holes transfers exhaust fluid. This alternation of high pressure fluid and exhaust fluid on each side of the rotor provides the desired balance.

SUMMARY OF THE PRESENT INVENTION

The present invention provides a rotary fluid pressure device comprised of a housing member, a manifold assembly, a gerotor set, an end plate, and a rototably journaled torque transer shaft. This invention overcomes the obstacle of balancing components within the gerotor set during operation of the rotary fluid pressure device.

A feature of the present invention is to provide a rotary fluid pressure device where the housing member defines a fluid inlet port, a fluid outlet port, a first flow passage, a second flow passage and an internal bore. The manifold assembly has a first fluid passage, a second fluid passage, an internal bore, with one side of the manifold assembly adjoining the housing member. The gerotor set has an internally toothed stator member, an externally toothed rotor member disposed within the stator member having an internal bore and a first and a second axial end surface. One of the stator and the rotor members has orbital movement relative to the other member, and the rotor member has a rotational movement relative to the stator. The internal teeth of the stator member and the external teeth of the rotor member interengage to define a plurality of expanding and contracting volume chambers. A first plurality of circumferentially spaced laterally directed fluid paths in the rotor extend through the rotor for fluid connection with the manifold assembly first and second fluid passages. A branch conduit for each of the first plurality of fluid paths adapted for directly connecting respective ones of the first plurality of laterally-directed fluid paths in the rotor to the volume chambers. A second plurality of circumferentially spaced, laterally-directed fluid paths extending through the rotor circumferentially interposed between the first plurality of fluid paths for sequentially channeling fluid between one of the first and second axial end faces. The gerotor set is located between the manifold assembly and the end plate. The rotatably journaled torque transfer shaft is operatively interconnected to the rotor and extends from within the housing member. A plurality of coupling members interconnects the endplate, the gerotor set, the manifold assembly and the housing member.

Another feature of the rotary pressure device is that the first and second plurality of laterally directed fluid paths are substantially axially directed, and that the branch conduits are substantially radially directed. A further feature includes having the first plurality of laterally directed fluid paths in the rotor being located in the rotor between externally toothed members thereof, and having the first plurality of laterally directed fluid paths being substantially laterally directed between the rotor first and second axial ends. Further the first plurality of laterally directed fluid paths could be substantially circumferentially centered between adjacent ones of the rotor externally toothed member thereof.

A further feature of the rotary pressure device is that the second plurality of laterally directed fluid paths is circumferentially centered between the first plurality of laterally directed fluid paths. Also the second plurality of laterally directed fluid paths in the rotor is substantially laterally directed between the rotor first and second axial ends, and wherein the second plurality of laterally directed fluid paths in the rotor is substantially radially aligned with adjacent ones of the rotor externally toothed members. Another feature is wherein the pluralities of the first and second laterally-directed fluid paths are substantially parallel.

Still another feature includes having one of the first and second axial end faces on the rotor having a first plurality of circumferentially spaced recesses located thereon, each of the first plurality of recesses in fluid communication with the first plurality of laterally directed fluid paths. Further, the first plurality of circumferentially spaced recesses can receive fluid for reducing the viscous friction between one of the first and second axial end faces and the end plate. Also, another feature is to minimize the number of circumferentially spaced recesses that do not receive a flowing fluid.

An additional feature of the present invention includes having one of the first and second axial end faces on the rotor having a second plurality of circumferentially spaced recesses located thereon, and each of the second plurality of recesses being in fluid communication with the second plurality of laterally directed fluid paths. Further the second plurality of circumferentially spaced recesses receive fluid for reducing the viscous friction between one of the first and second axial end faces and the end plate. Also, another feature is to minimize the number of circumferentially spaced recesses that do not receive a flowing fluid.

Yet another feature of the present invention includes having the plurality of laterally directed first and second fluid paths in the rotor extend through the rotor from the first axial end surface to the second axial end surface. An added feature of the present invention includes having the rotary fluid pressure device function as one of a hydraulic pump and motor.

Still another feature of the present invention involves having some of the housing member first and second flow passage, the manifold assembly first and second fluid passage as well as the pluralities of the rotor first and second laterally directed fluid paths being utilized for both high pressure and exhaust fluid passage. Also the housing member first flow passage and the manifold assembly first fluid passage could be conduits for high pressure fluid, and the housing member second flow passage and the manifold assembly second fluid passage could be conduits for exhaust fluid. Further features of the present invention will become apparent to those skilled in the art upon reviewing the following specification and attached drawings. Further features of the present invention will become apparent to those skilled in the art upon reviewing the following specification and attached drawings.

BRIEF DESCRIPTION OF THE DRAWINGS

FIG. 6*a*' shows FIG. 6 together with the manifold plate.

FIG. 6*b*' shows the rotor relative to the adjacent manifold plate at 18° counterclockwise.

FIG. 6*c*' shows the rotor relative to the adjacent manifold plate at 36° counterclockwise.

DETAILED DESCRIPTION OF THE PREFERRED EMBODIMENT

Figure 1:
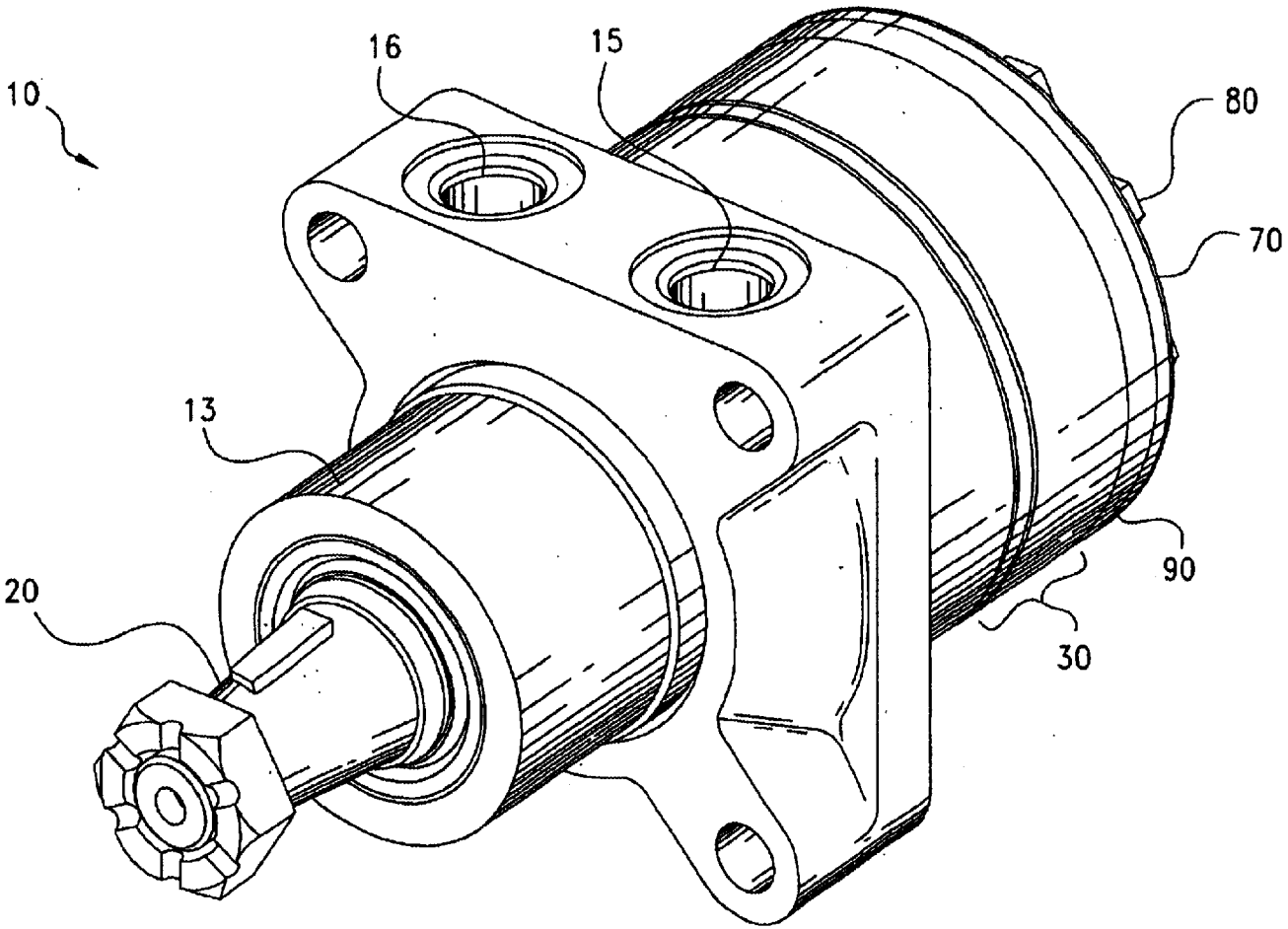
FIG. 1 is a perspective view of a hydraulic motor according to the present invention.

Referring to the drawings, and initially to FIG. 1, it illustrates a compact rotary fluid pressure device 10 utilizing an IGR (Internally Generated Rotor), such as a hydraulic motor or pump (hereinafter referred to as "hydraulic motor" for ease of description) according to the present invention. Hydraulic motor 10 is designed for various applications, but is especially adapted for high torque, low speed use. As is discussed in detail below, hydraulic motor 10 is fully hydraulically balanced, has a simplified flow distribution through the manifold and gerotor set, and has a reduced number of individual components. In addition, this new design provides high starting torque while retaining high durability.

Figure 2:
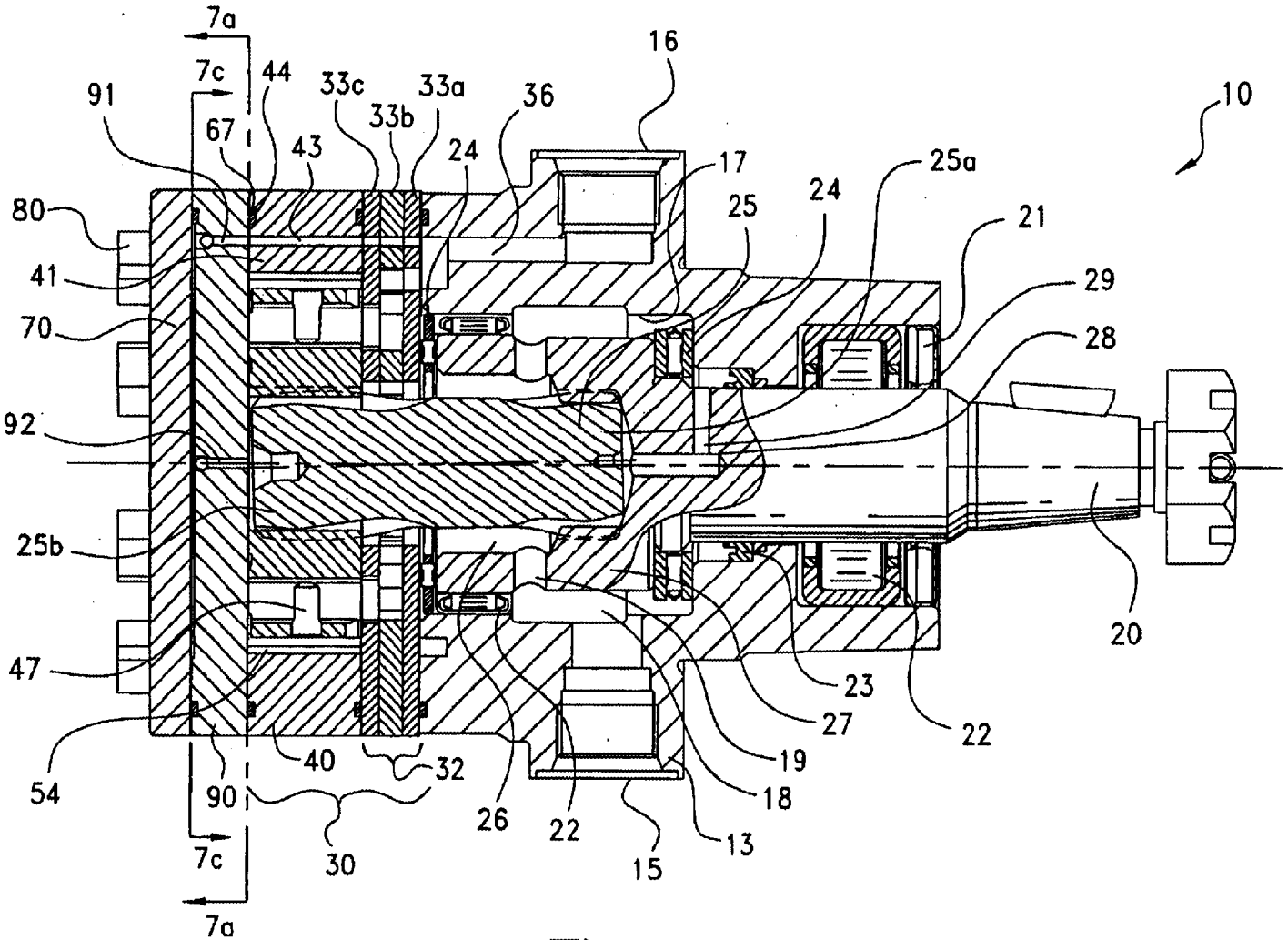
FIG. 2 is a sectional view of the hydraulic motor.

As shown in FIGS. 1 and 2, hydraulic motor 10 includes the following main components: Shaft housing 13 is located at one end (front) of rotary fluid pressure device 10 and surrounds a torque-transfer shaft, which could be comprised of a coupling shaft 20, or a straight-shaft 120 (shown in FIG. 10). A first and a second port, 15, 16, are integrated into shaft housing 13 and alternately provide, depending on the direction of rotation of shaft 20, an inlet and outlet port for hydraulic motor 10. An end cover 70 is located at the other end (rear) of hydraulic motor 10. A channeling plate 90 is located inwardly adjacent to end cover 70. A drive assembly 30 is interposed between shaft housing 13 and channeling plate 90. A drive link 25 extends through drive assembly 30 and into shaft housing 13. A plurality of peripherally-spaced bolts 80 extend through holes 81 (shown in FIG. 3) and connect end cover 70, channeling plate 90, drive assembly 30 and shaft housing 13.

Shaft housing 13 has a stepped internal bore 17 for receiving and rotatably supporting coupling shaft 20. Within an axial front portion of internal bore 17, a dirt seal 21 is positioned surrounding shaft 20 and prevents outside contaminants from entering internal bore 17. Two axially-spaced radial bearings 22 are located within internal bore 17 for rotatably supporting shaft 20. A high pressure shaft seal 23 is provided in a fluid-tight arrangement around shaft 20 in order to prevent any internal fluid from leaking into the front portion of bore 17. Two axially-spaced thrust bearings 24 are located within internal bore 17 and prevent coupling shaft 20 from moving axially. Extending axially from an inner end of second port 16 is an axial passageway 36 that connects port 16 with a circumferential fluid chamber 37 abutting one end of drive assembly 30.

Coupling shaft 20 has a rear clevis portion 27 having a hollow center with internal splines. Coupling shaft rear portion 27 includes an axial passageway 28 that extends from its hollow center into a radial passageway 29, which in turn is in fluid communication with a fluid chamber 18 located within shaft housing internal bore 17. Coupling shaft rear portion 27 also includes radial flow passages 19 connecting fluid chamber 26 and fluid chamber 18.

Drive link 25 has a front portion 25*a* and a rear portion 25*b*, both having external splines. The external splines on front portion 25*a* mate with complementary internal splines on coupling shaft rear portion 27. The external splines on rear portion 25*b* mate with complementary internal splines in drive assembly 30. A fluid chamber 26 surrounds drive link 25 and extends along a major portion of its axial extent.

Figure 9:
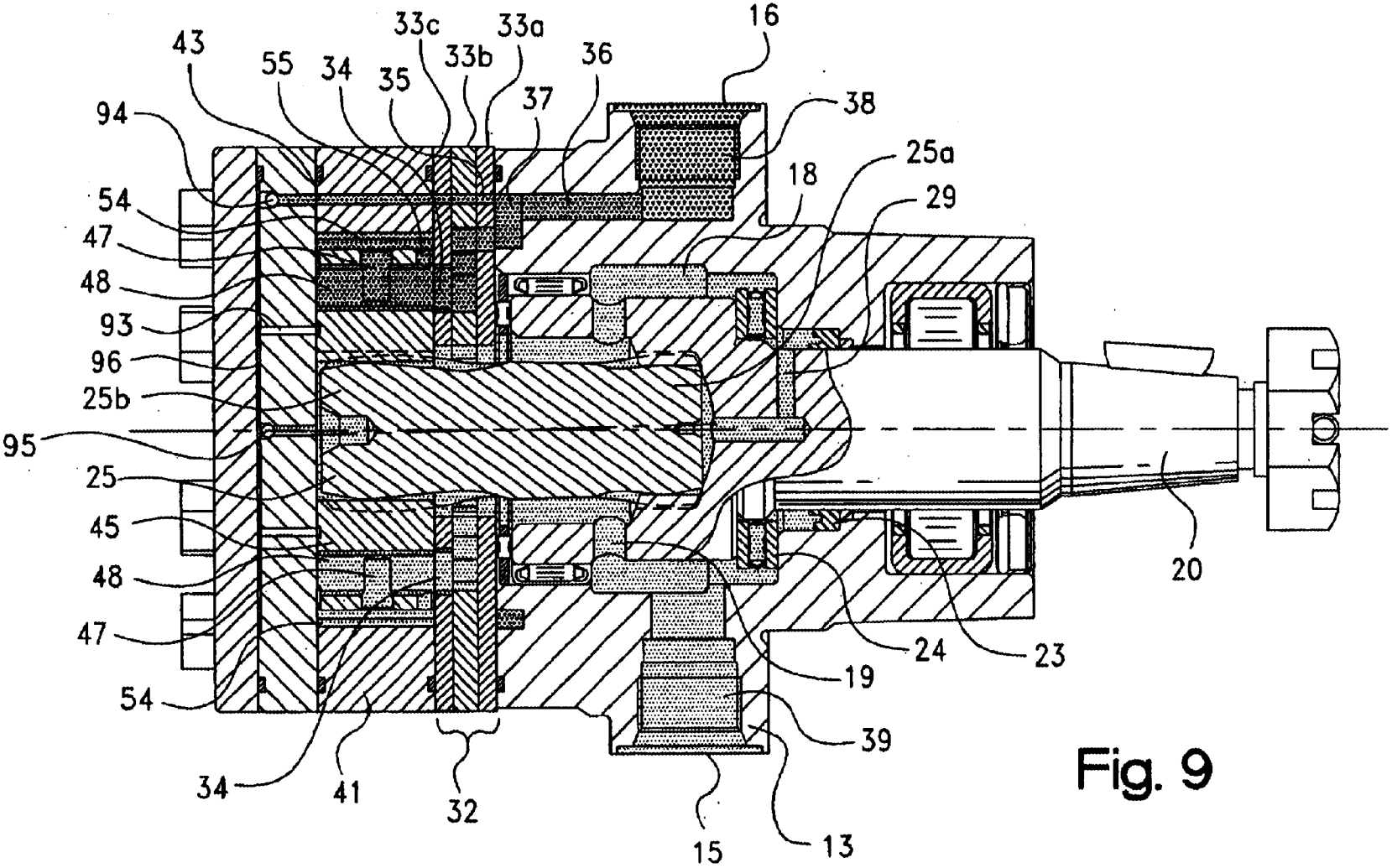
FIG. 9 is a schematic illustration of the fluid circuit of the hydraulic motor of this invention showing the high pressure inlet flow and the exhaust flow.

Drive assembly 30 includes a manifold 32 and a gerotor set 40. Manifold 32 is comprised of a series of apertured individual plates 33*a–c* (shown in detail in FIGS. 5*a–c*) which are affixed together (e.g. by brazing or via peripherally-spaced bolts) in order to form two separate flow paths. The flow through all three affixed plates is shown in FIG. 9 and will be discussed in greater detail below. Each individual plate has a different path configuration extending therethrough. Referring cursorily to FIG. 9, these affixed plates provide a first flow path 38 extending between shaft housing 13 and gerotor set 40, and a second flow path 39 extending between gerotor set 40 and shaft housing 13 respectively.

Figure 5A:
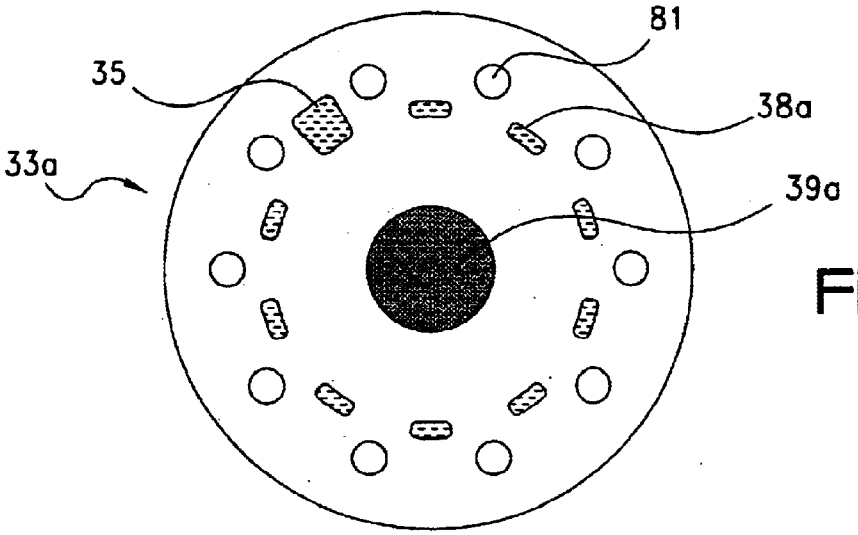
FIG. 5*a* is a frontal view of a manifold plate adjacent the shaft housing of the hydraulic motor.
Figure 5B:
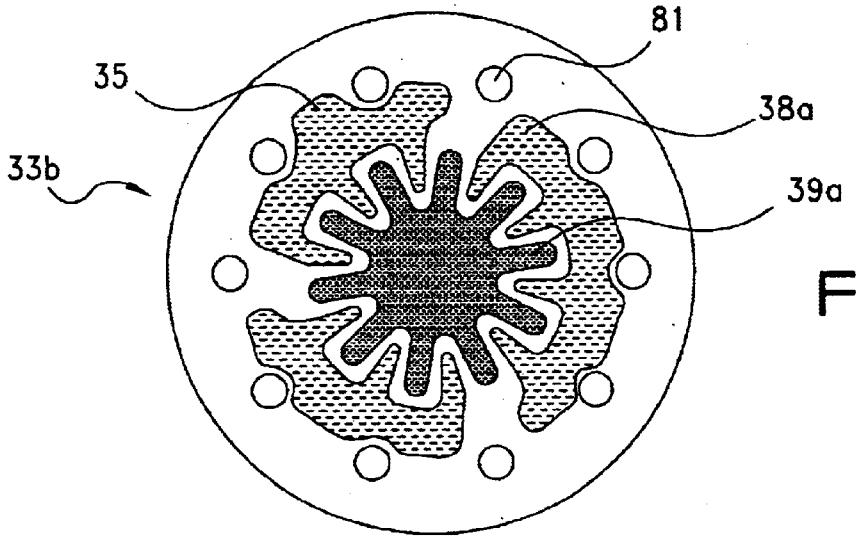
FIG. 5*b* is a frontal view of the middle manifold plate.
Figure 5C:
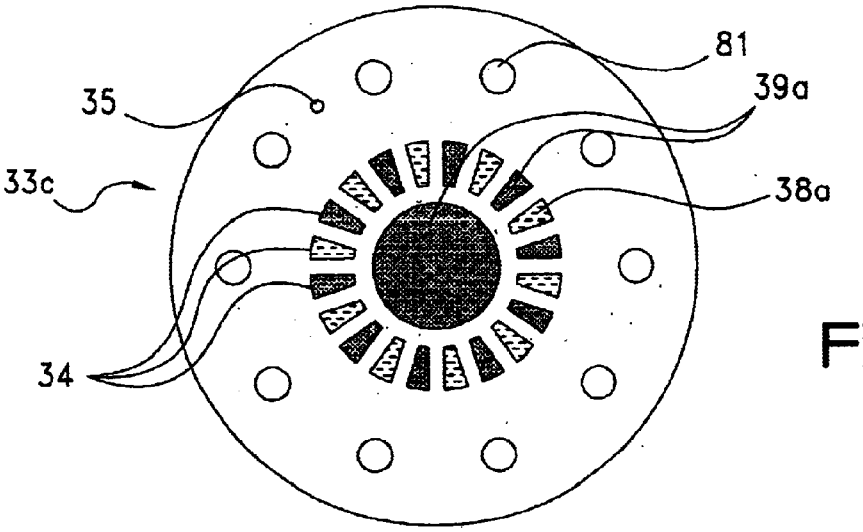
FIG. 5*c* is a frontal view of a manifold plate adjacent the gerotor.

Referring now to apertured affixed plates 33*a–c*, FIG. 5*a* shows plate 33*a*, one side of which is directly adjacent to shaft housing 13. The darker shaded apertures or areas 39*a* signify fluid from second flow path 39 (FIG. 9) through a central bore and the lighter shaded apertures or areas 38*a* signify fluid from first flow path 38 (FIG. 9) through a set of apertures radially spaced from central bore. The lighter shaded areas 38*a* align with fluid chamber 37 of shaft housing 13 when the components are assembled. FIG. 5*b* shows intermediate plate 33*b*, one side of which is adjacent to, and aligned with, the other side plate 33*a*, on the side opposite shaft housing 13. As in FIG. 5*a*, the lighter shaded areas 38*a* signify fluid from first flow path 38 and the darker shaded areas 39*a* signify fluid from second flow path 39. As can be seen, lighter shaded areas 38*a* are in a series of comb-like apertures having inwardly directed radial tooth-like members. Darker shaded areas 39*a* are in a single aperture comprised of a plurality of circumferentially spaced outwardly radially directed finger-like openings in communication with the center. It should be noted that the aperture continues from the center of plate 33*b* to the finger-like extensions. As previously noted, plates 33*a–c* are aligned, and affixed together. FIG. 5*c* shows plate 33*c* that is positioned between the other side of plate 33*b* and one end of gerotor set 40. Again the lighter shaded areas 38*a* signify fluid from first flow path 38 and the darker shaded areas 39*a* signify fluid from second flow path 39.

Figure 3A:
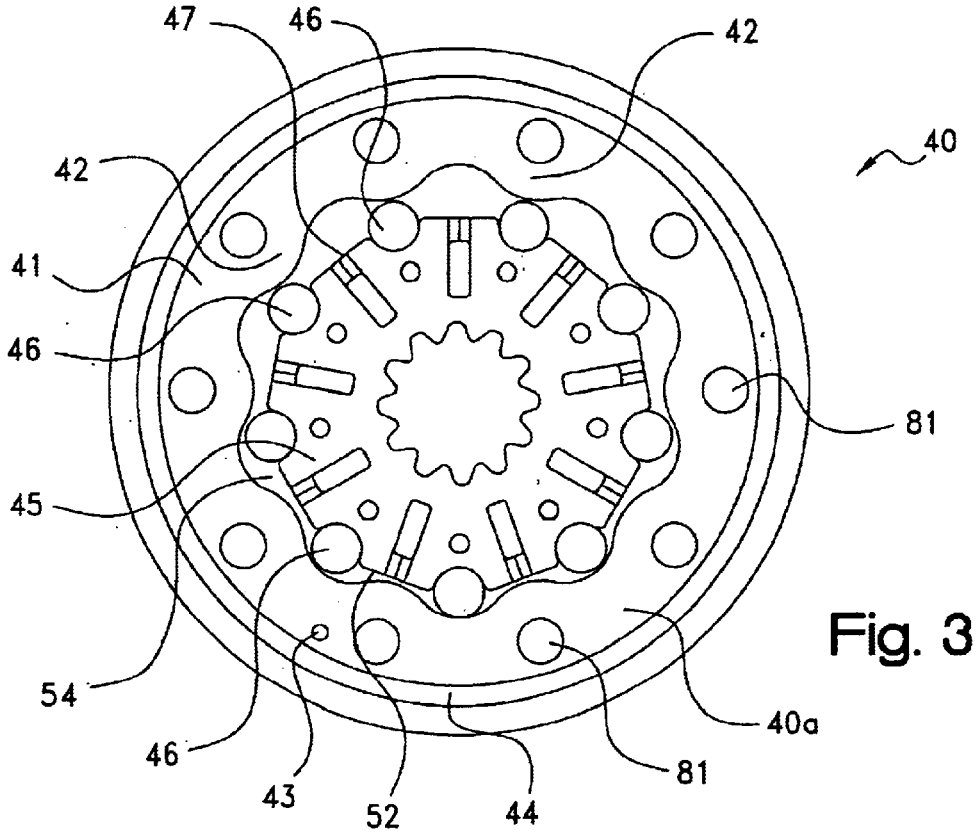
FIG. 3*a* is a cross-sectional view of a gerotor, a component of the hydraulic motor, shown from a first axial end.
Figure 3B:
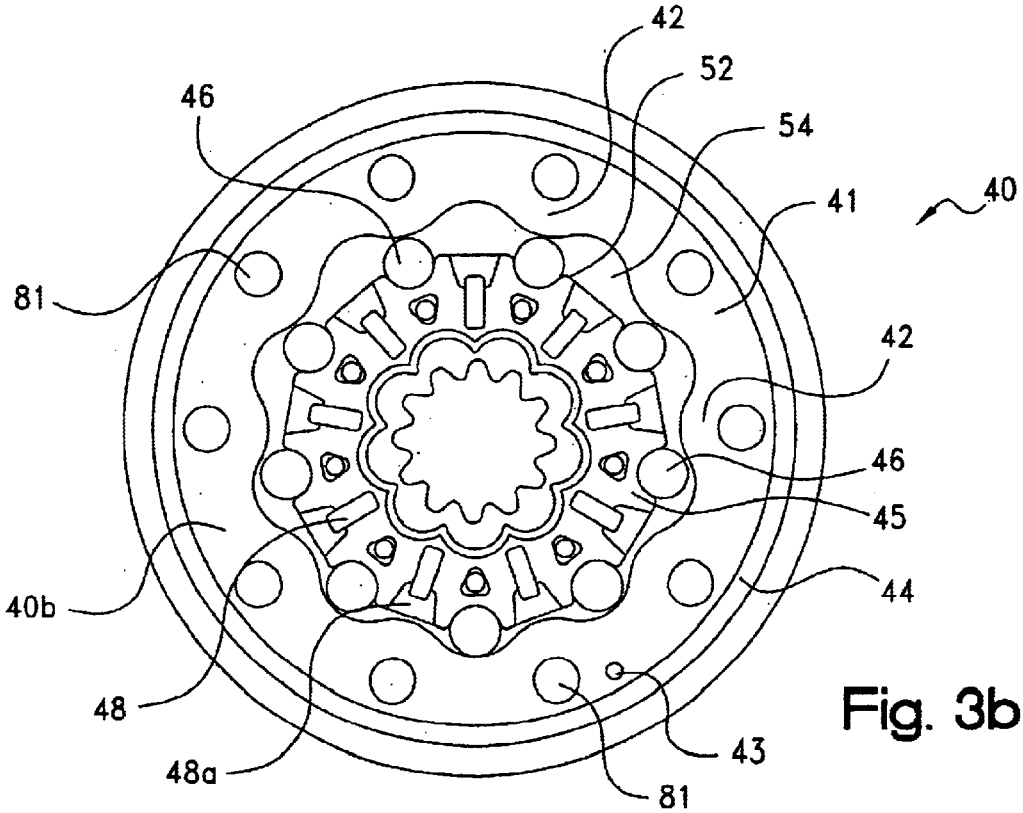
FIG. 3*b* is a cross-sectional view of the gerotor, similar to FIG. 3*a*, but shown from the opposite axial end.

Referring now to FIG. 3*a*, which shows gerotor set front side 40*a*, and FIG. 3*b*, which shows gerotor set back side 40*b*, gerotor set 40 consists of an outer stator 41 and an inner rotor 45. Outer stator 41 has a plurality, N+1, of internal gear teeth 42, that provide conjugate interaction with a plurality, N, of gear teeth 46 on the outer periphery of inner rotor 45. Rotor gear teeth 46 preferably have a circular arc shape and can be replaced with hardened rollers for high efficiency gerotor set, motors. The use of hardened rollers for rotor gear teeth 46 reduces wear, friction, and leakage in the hydraulic motor.

Figure 4B:
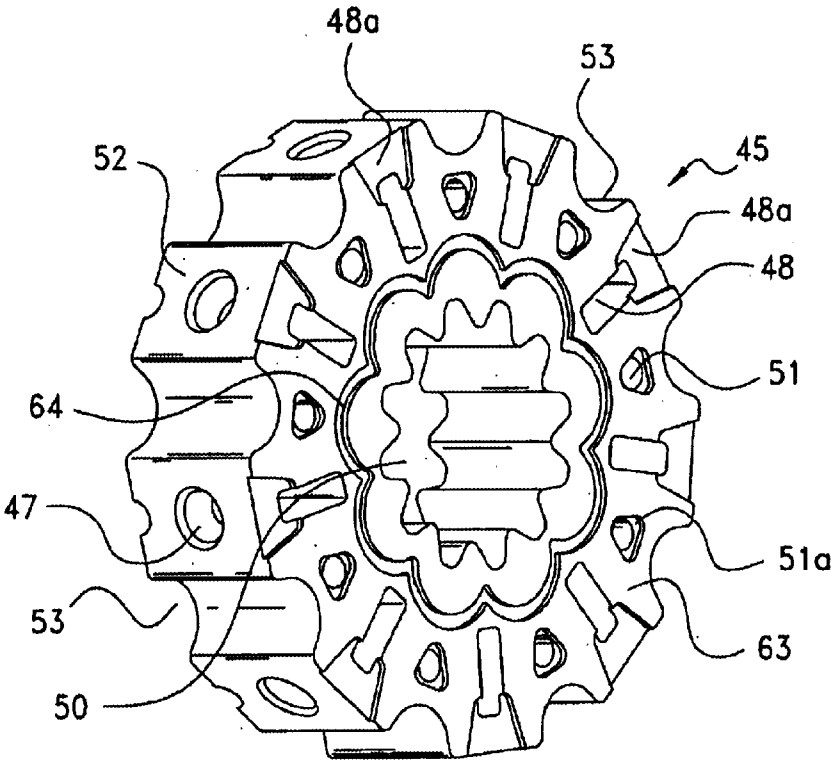
FIG. 4*b* is an elevational view of the rotor, similar to FIG. 4*a*, but shown from the opposite axial end as that in FIG. 4*a*.
Figure 4A:
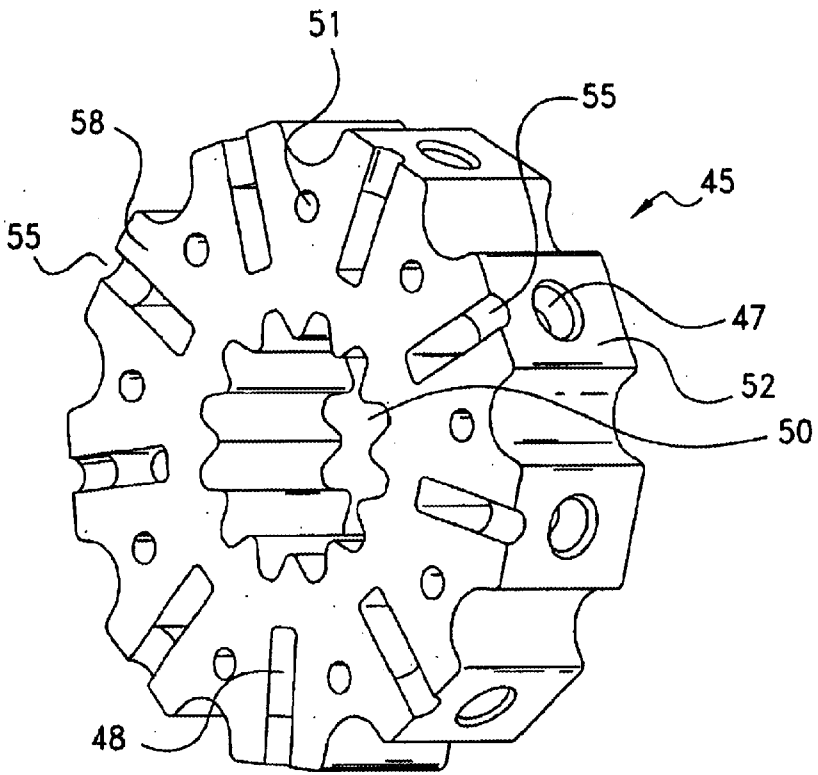
FIG. 4*a* is an elevational view of the rotor, as viewed from a first axial end.

Referring to FIG. 4*a*, the front side 58, or the side adjacent manifold plate 33*c*, of rotor 45 is shown. Front side 58 shows two sets of pluralities of passages, axial passages 48 and axial through orifices 51, both extending through the rotor. Both sets of passages 48 and 51 have openings on both axial sides of rotor 45 (as shown in FIGS. 4*a–b*). As will be discussed in detail below, each axial passage 48 is used as a passageway for high-pressure fluid and exhaust fluid. As will also be discussed below, each axial through orifice 51 is used for improving the rotary movement of rotor 45. The outer periphery of rotor 45 is defined by a series, nine in the example shown in FIG. 4*a*, of equally circumferentially-spaced intermediate portions 52 separated via a series of semi-cylindrical pockets or recesses 53 which serve to receive rotor gear teeth or rollers 46. Spaced portions 52 have a radial outer surface which preferably is substantially perpendicular (but not limited thereto) to rotor front side 58, rotor back side 63, and any radial plane emanating from the axial center line of the rotor internal bore, or apertured center. The apertured center of rotor 45 is provided with internal splines 50 located at its peripheral surface for mating engagement with the external splines of drive line rear portion 25*b*. This engagement transfers high torque from rotor 45 to drive link 25 and from same to coupling shaft 20.

FIG. 4*b* shows the rear side surface 63, or the side adjacent channeling plate 90, of rotor 45. Axial passages 48 and axial through orifices 51, both extending from front side surface 58, are shown. Surrounding each through orifice 51 and extending slightly axially into rotor rear side 63 is a recess 51*a* which can be trapezoidal in shape and is coaxial with orifice 51. The radial upper or outer portion of each axial passage 48 is provided with another recess 48*a*, which also can be trapezoidal in shape, and extends radially outward into flat portion 52. During operation, recesses 48*a* and 51*a* are filled with fluid for the purpose of reducing the viscous friction between rotating rotor 45 and non-rotating channeling plate 90. Viscous friction is also reduced due to the reduction of the outer annular area of rotor rear side surface 63 via recesses 48*a* and 51*a*. A flower-shaped or multiple-convoluted recess 64 is positioned radially outward of rotor internal splines 50 in rotor rear side surface 63 and continues along the whole circumference thereof. As will be discussed below, recess 64 always receives high pressure fluid in order to overbalance rotor 45, thus axially biasing rotor 45 towards manifold 32 in order to reduce fluid leakage between manifold 32 and gerotor set 40, which interface is referred to as the valve interface.

Rotor 45 has a plurality, N, of central, individual radial fluid channels 47 within flat portions 52. Radial fluid channels 47 are preferably at least one of substantially axially centered between rotor front side 58 and rear side 63, and substantially circumferentially centered relative to their adjacent rotor gear teeth 46 (FIG. 3*a*), and preferably both substantially axially and substantially circumferentially centered. One (inner) end of each radial fluid channel 47 opens into an axial passage 48, extending through rotor 45, and the other (outer) end opens radially into a gerotor set volume chamber 54 (as shown in FIGS. 3*a–b*). The end of passage 48 that opens into gerotor set volume chamber 54 is preferably centered within equally circumferentially spaced intermediate portions 52. Each volume chamber 54 is bounded by two nearby inner rotor gear teeth 46, circumferentially-spaced portion 52 of the rotor outer peripheral surface, and the undulating internal surface of stator 41. Gerotor set 40 has N volume chambers, which coincides with the number of fluid channels 47. Rotor 45 also has a plurality, N, of individual radial fluid channels 55 located at either, or both, rotor front side 58 or rotor rear side 63 of rotor 45. Radial fluid channels 55 are shown at rotor front side 58, but can also be placed on rotor rear side 63. Radial fluid channels 55 are preferably circumferentially centered in the manner preferably described with reference to channels 47, and preferably parallel with channels 47.

Referring to FIGS. 2, 3*a* and 3*b*, stator 41 is shown in detail. As mentioned above, stator 41 has internal gear teeth 42, that interact with gear teeth 46 of inner rotor 45. Located radially outward of gear teeth 42 are bolt holes 81 for receiving bolts 80, which affix stator 41 between a channeling plate 90 and manifold 32. A through hole 43 extends axially through stator 41. Positioned radially outward of through hole 43 are two circumferential seal cavities 44, located on both axial end surfaces of stator 41, for receiving seals 67.

Figure 7C:
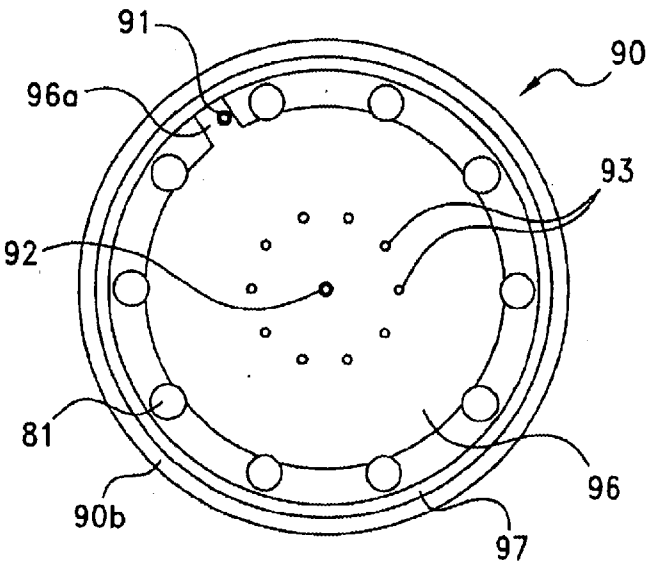
FIG. 7*c* is a rear view of the channeling plate taken along line 7*c*—7*c* in FIG. 2.
Figure 7B:
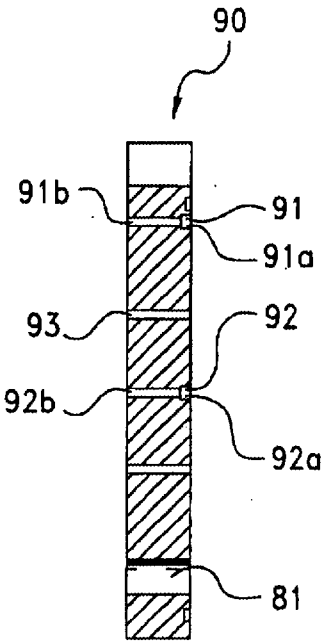
FIG. 7*b* is a sectional view of the flexible balancing plate taken along line G—G of FIG. 7*a*.
Figure 7A:
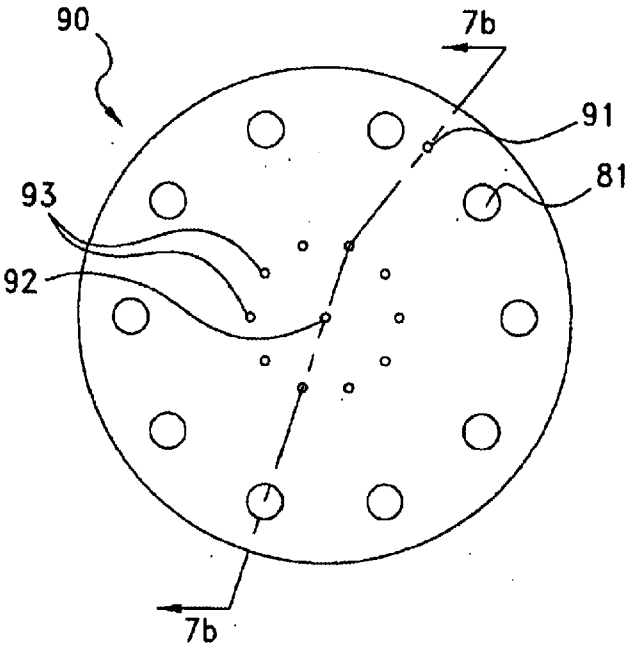
FIG. 7*a* is a frontal view of a channeling plate of the present invention taken along line 7*a*—7*a* in FIG. 2.

Referring to FIGS. 7*a–c*, channeling plate 90 is shown with bolt holes 81, for receiving bolts 80 (not shown), extending therethrough. A first check valve opening 91 extends through channeling plate 90, with check valve opening 91 being defined by a first portion 91*a* and a second portion 91*b*. First portion 91*a* has a diameter larger than second portion 91*b* such that it can receive a check ball (not shown) having a diameter larger than that of second portion 91*b*. When assembled, as shown in FIG. 2, second portion 91*b* is aligned with stator through hole 43 and is in fluid communication with first flow path 38 (as shown in FIG. 9). A second check valve opening 92 also extends through channeling plate 90, and, similar to check valve opening 91, opening 92 has a first portion 92*a* and a second portion 92*b*. First portion 92*a* has a diameter larger than second portion 92*b* such that it can also receive a check ball (not shown) having a diameter larger than that of second portion 92*b*. When assembled, as shown in FIG. 2, second portion 92*b* is coaxial with the center of gerotor set 40 and is in fluid communication with second flow path 39 (as shown in FIG. 9). At least one further through hole 93 and preferably a plurality of circularly spaced holes 93 extend through channeling plate 90 and are situated in a location between but not radially aligned with both first and second check valve openings 91 and 92. When assembled, (not shown), at least one through hole 93 is aligned with multiple-convoluted recess 64 on the rotor back side 63 (as shown in FIG. 4*b*). It should be understood that the convoluted shape of recess 64 is due to the fact that rotor 45 both rotates and orbits at the same time. At least one through hole 93 supplies high pressure fluid to multiple-convoluted recess 64. FIG. 7*c* shows the inner axial surface 90*b* of channeling plate 90 which is directly adjacent end cover 70. A coaxial circular recess 96 for receiving high pressure fluid, detailed below, is shown. A recessed coaxial annular seal cavity 97 is positioned, radially outside of bolt holes 81 with seal cavity 97 receiving seal 67 (not shown). Recess 96 has a flow channel 96*a* extending radially outward and terminating into seal cavity 97. Check valve opening 91, and more specifically first portion 91*a*, is centered within flow channel 96*a*.

Figure 8C:
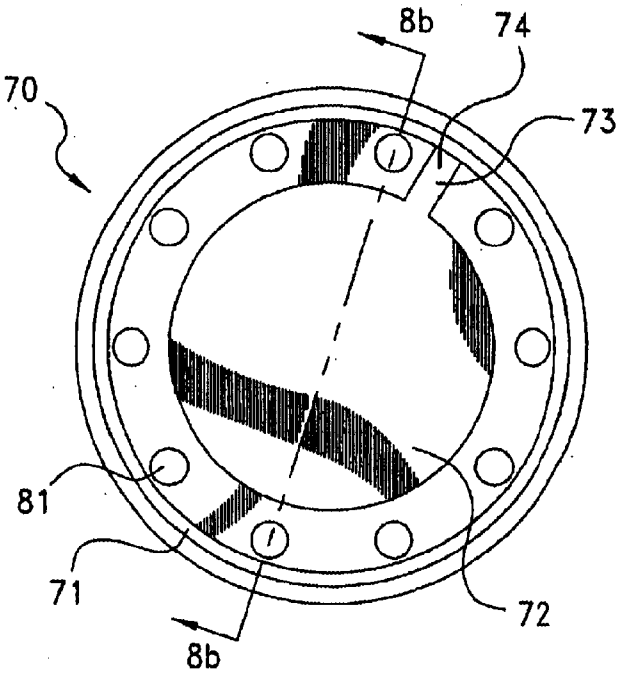
FIG. 8*c* is a frontal view of the alternate embodiment of the end cover.
Figure 8B:
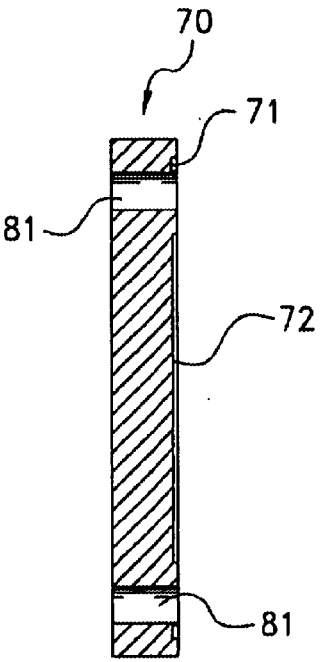
FIG. 8*b* is a cross-sectional side view of an alternate embodiment of end cover taken along line 8*b*—8*b* of FIG. 8*c*.
Figure 8A:
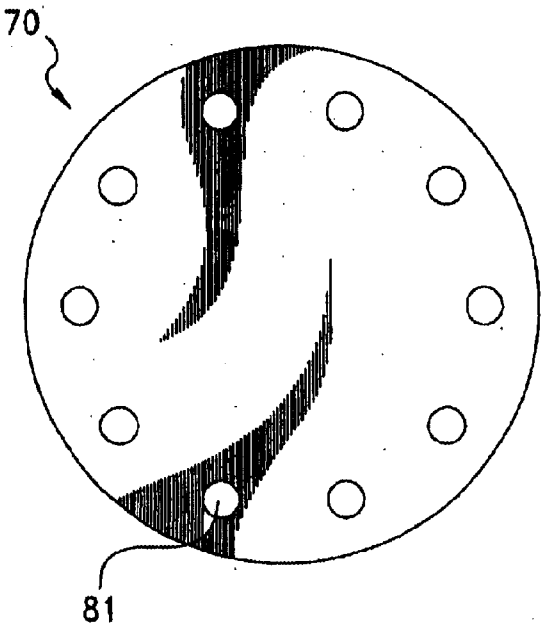
FIG. 8*a* is a rear view of an end cover of the present invention.

Referring to FIG. 8*a*, the substantially flat outer axial surface of end cover 70 is shown. In the present invention, the inner axial surface of end cover 70 is substantially similar to that of the axial outer surface shown in FIG. 8*a*. Bolt holes 81 extend through end cover 70 and receive bolts 80, not shown, which align end cover 70 with channeling plate 90. As part of another embodiment of the invention, FIGS. 8*b–c* show how recess 96 and seal cavity 97 of channeling plate 90 can alternately be incorporated into the inner axial surface of end cover 70 rather than being incorporated in channel plate 90. Similar to the design of FIGS. 7*b* and 7*c*, a coaxial circular recess 72 is incorporated into the inner axial surface of end cover 70 for receiving high-pressure fluid. A recessed coaxial annular seal cavity 71 is positioned, radially outside of bolt holes 81, in end cover 70, with seal cavity 71 receiving a seal, similar to seal 67. FIG. 8*c* shows the inner axial surface of end cover 70, as part of the alternate embodiment, which is directly adjacent channeling plate 90. Recess 72 has a flow channel 73 extending radially outward, with flow channel 73 having its radial outer portion 74 terminating into end cover seal cavity 71. When assembled, flow channel radial outer portion 74 is radially and axially aligned with first portion 91*a* of first check valve opening 91.

The hydraulic circuit and operation of hydraulic motor 10 will now be discussed. Referring first to FIG. 9, the fluid path for hydraulic motor 10 is shown when it operates in a first direction. High pressure fluid 38 enters second port 16 and follows the path indicated by darker shading with triangular shapes. It should be noted that although fluid 38 is shown entering port 16 in FIG. 9, this path could be reversed with exhaust fluid emanating therefrom. Ports 15 and 16 can be either inlet or outlet ports, depending on the desired direction of rotation of hydraulic motor 10. For sake of description, the triangular shaded path was chosen to represent high pressure inlet fluid 38, with fluid 38, entering port 16, traveling axially through passageway 36 and entering fluid chamber 37. Fluid 38 then travels into manifold 32 through the axially aligned passages in manifold plate 33*a* (as seen and indicated by 38*a* in FIG. 5*a*). Fluid 38 further flows axially from plate 33*a* into plate 33*b* (as shown and indicated by 38*a* in FIG. 5*b*) and travels radially inwardly while passing through this plate. Fluid 38 continues its flow into and axially through a plurality, N+1, of aligned openings 34 in plate 33*c* (as shown and indicated by 38*a* in FIG. 5*c*), with openings 34 being aligned with rotor axial passages 48 and fluid 38 passing into these passages. Finally, fluid 38 then flows radially outwardly through fluid channels 47 (FIG. 4*b*) within rotor 45 into gerotor set volume chambers 54. Fluid 38 also flows radially outward through fluid channel 55 (FIGS. 4*a* and 9) into volume chambers 54. The pressurized fluid 38 causes volume chambers 54 to expand. As well known to those skilled in the art, this fluid communication causes rotor 45 to rotate and orbit within fixed stator 41. The expanding volume chambers, coupled with the rotation and orbiting of rotor 45, i.e., hypocloidal movement, will cause other volume chambers 54 to contract. Contraction of volume chambers 54 provides the exhausting, or return fluid flow indicated by second flow path 39.

Exhausting fluid 39 is indicated with dotted shading, and begins its flow with the contraction of gerotor set volume chambers 54 forcing exhaust fluid 39 radially inwardly through rotor fluid channels 47. Fluid 39 enters axial fluid passages 48 (FIG. 4*c*), flows towards plate 33c and enters the aligned openings 34 therein (as shown and indicated by 39*a* in FIG. 5*c*). Fluid 39 then travels into manifold plate 33*b* and flows radially inwardly while passing therethrough (as shown and indicated by 39*a* in FIG. 5*b*). Fluid 39 continues its flow axially through the center of plate 33*a* (as shown and indicated by 39*a* in FIG. 5*a*).

Drive link 25 (FIG. 9) extends freely through the center of manifold plates 33*a–c* and its rear end 25*b* is linked to rotor 45, via the previously-described cooperating spline arrangement, and rotates and orbits with rotor 45. Therefore, the portion of drive link 25 that extends through the center of manifold plates 33*a–c* is not sealed against the inside surface of plates 33*a–c*. Thus fluid 39, upon reaching the center of plate 33*b* is free to travel along the outside surface of drive link 25. This provides a lubricant for drive link 25, as well as being an exhaust path for the fluid flow. Exhaust fluid 39 will travel axially along drive link 25 towards coupling shaft 20 then radially outward through passageway 19 within shaft housing 13. Exhaust fluid 39 then reaches fluid chamber 18 where it continues radially outward and exits through first port 15, which in this example functions as an outlet port. Exhaust fluid 39 will occupy all gap areas between drive link front portion 25*a* and coupling shaft 20, and all areas between coupling shaft 20 and shafting housing 13. Radial passageway 29 provides a path between the areas surrounding coupling shaft 20 and the areas within coupling shaft 20. Fluid 39 passing through these areas provides lubrication for these moving parts and removes heat. Due to the rotation of coupling shaft 20, the centrifugal flow of fluid through radial passageway 29 takes the heat away from seal 23 and thrust bearings 24, while traveling towards and out of first port 15.

It should again be noted that the directions of fluid travel are chosen for example purposes only and can be reversed by switching the fluid streams communicating with ports 15 and 16. If the fluid streams were reversed, high-pressure fluid would then enter port 15 and would travel in the direction indicated by the dotted shading. After entering port 15, high pressure fluid would flow into shaft housing 13, axially along drive link 25 through the central aperture of plate 33*a* and radially upwardly into manifold plate 33*b*. Unlike the above discussed example, in which high pressure fluid enters manifold 32 axially, high pressure fluid would now enter manifold 32 radially. As mentioned above, the aperture in manifold plate 33*b* extends from the center radially outwardly so high-pressure fluid can travel from directly from the central internal bore radially outward before flowing in the axial direction.

Referring again to FIG. 9 and the example where high pressure fluid 38 enters port 16, when high pressure fluid 38 reaches manifold plate 33*c*, a certain amount of fluid travels through an axial passageway 35 (which is comprised of portions 35*a–c*) in manifold plates 33*a–c* respectively into aligned stator through hole 43. If the pressure of this fluid 38 is greater than a predetermined value it will crack a first check valve 94 and fill channeling plate recess area 96. Fluid 38 will then travel via at least one through-hole 93 in channeling plate 90 and fill flower-shaped recess 64 (as shown in FIG. 4*b*) in rotor back side 63. In a similar fashion, when high pressure fluid enters port 15 and travels in a direction indicated by the dotted shading in FIG. 9, fluid 39 will travel along the outer surface of drive link rear portion 25*b* and will crack, if the pressure is sufficient, a second check valve 95 in channeling plate 90. Fluid 39 will fill channeling plate recess area 96, flow via at least one through-hole 93 in channeling plate 90 and fill flower-shaped recess 64 in rotor back side 63. In either of these flow examples, high pressure fluid in flower-shaped recess 64 would act on rotor back side 63 and axially bias rotor 45 toward manifold 32. This biasing action will substantially reduce leakage between gerotor set 40 and manifold 32.

Although channeling plate 90 has high-pressure fluid passing (in both axial directions) therethrough, it remains substantially rigid due to its thickness. As an example, a 5" diameter channeling plate 90 can have a thickness of approximately 0.5", so that it will only negligibly deform and not physically contact rotor 45. This lack of deformation is unlike prior art designs which provide thinner, flexible balancing plates which come in physical contact with the rotor to provide stability to an unbalanced rotor. Channeling plate 90 acts as a passageway for directing high-pressure fluid, either 38 or 39, towards rotor 45. Unlike prior art designs, where the channeling plate will flex and contact the rotor in order to minimize the gap between the rotor and the manifold set, the present invention uses only high-pressure fluid to bias rotor 45 toward manifold 32 in order to minimize the gap. Therefore channeling plate 90 does not physically contact rotor 45 as a result of the negligible elastic deformation of channeling plate 90, but merely provides a passageway for the high-pressure fluid. A thin layer of high-pressure fluid separates channeling plate 90 and rotor 45. Since only high-pressure fluid is received within flower-shaped recess 64, the pressure on rotor back-side 63 is greater than the pressure on rotor front side 58. Without the hydraulic biasing force provided by the high-pressure fluid acting on rotor 45 via recess 64, the pressure forces on opposite rotor sides, 58 and 63, is substantially equal.

Figure 6A:
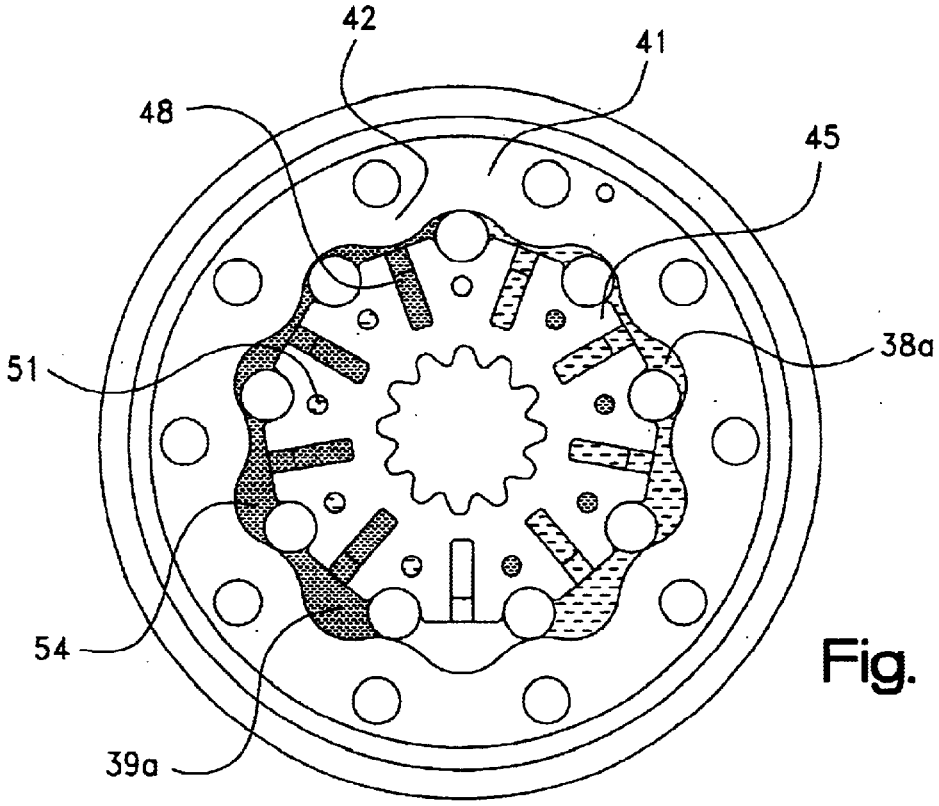
FIG. 6*a* is an end view showing the rotor relative to the stator at 0°.
Figure 6A:
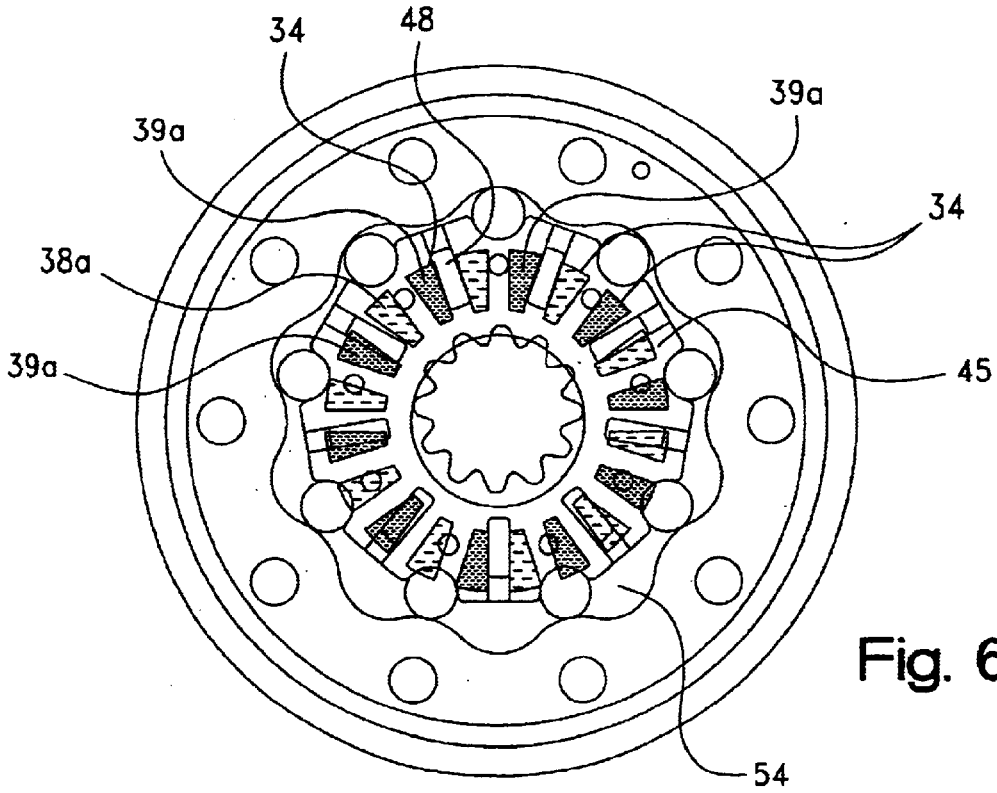
Figure 6B:
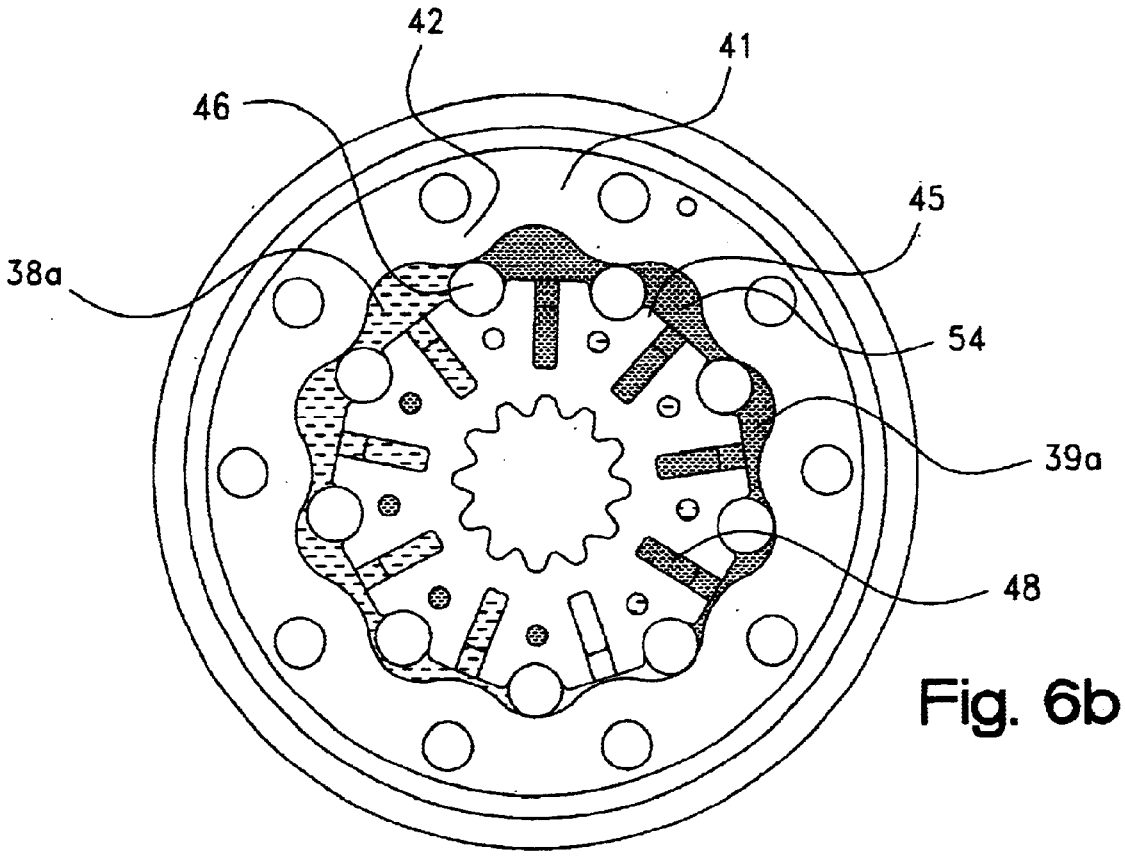
FIG. 6*b* is an end view showing the rotor relative to the stator at 18° counterclockwise.
Figure 6B:
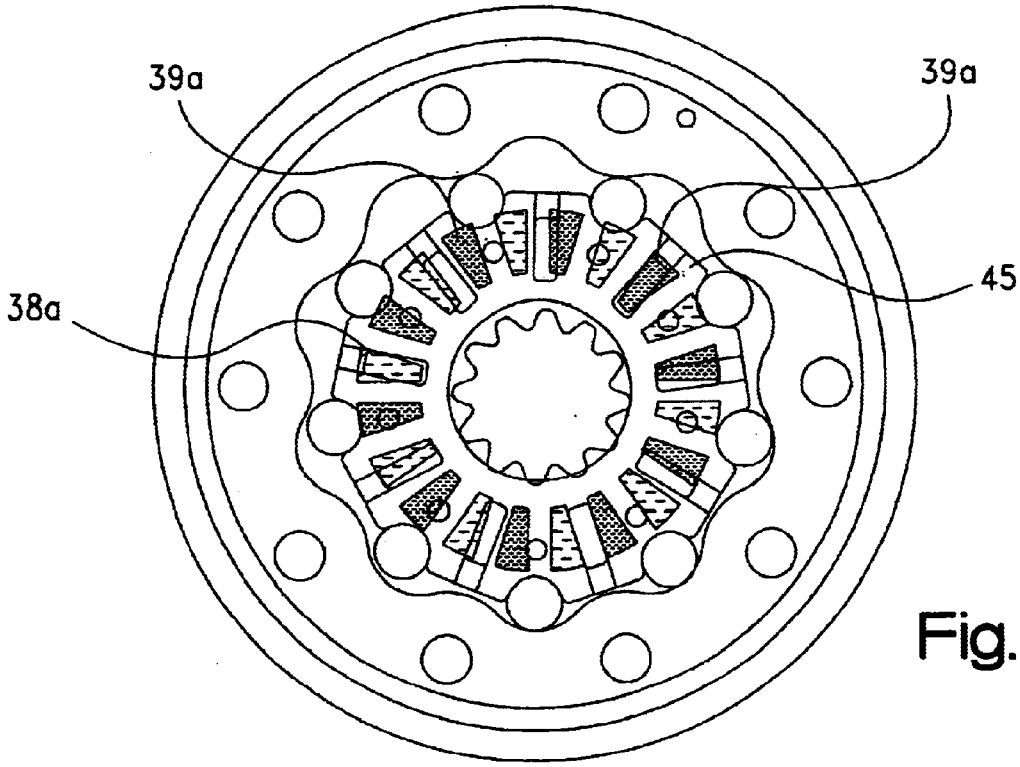
Figure 6C:
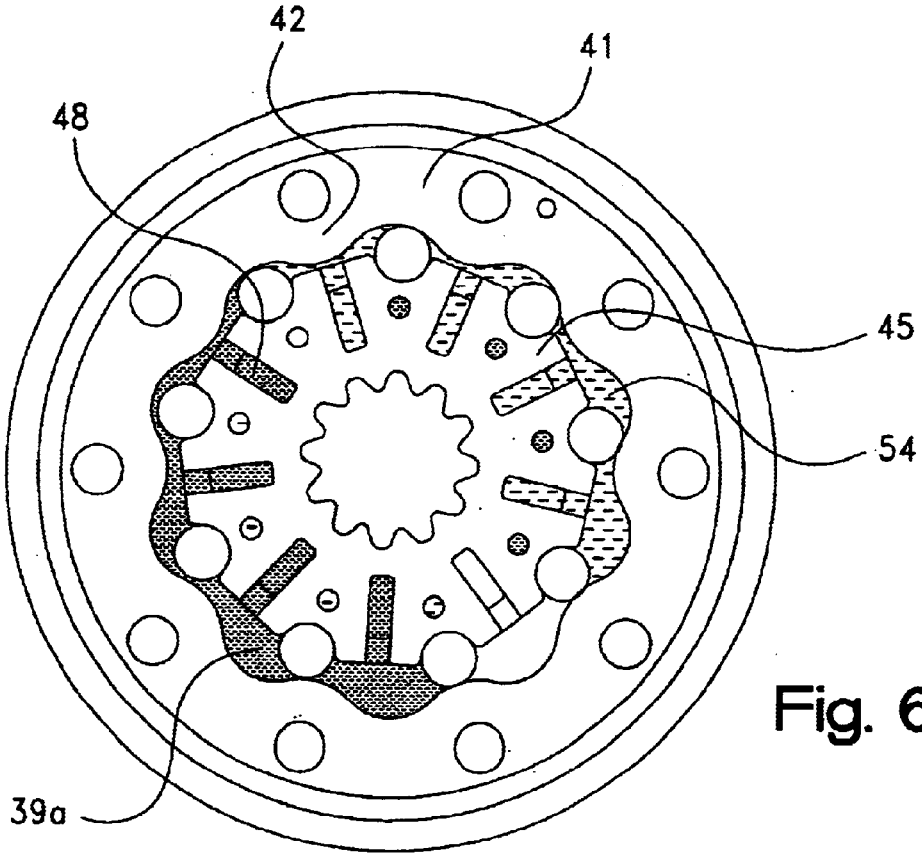
FIG. 6*c* is an end view showing the rotor relative to the stator at 36° counterclockwise.
Figure 6C:
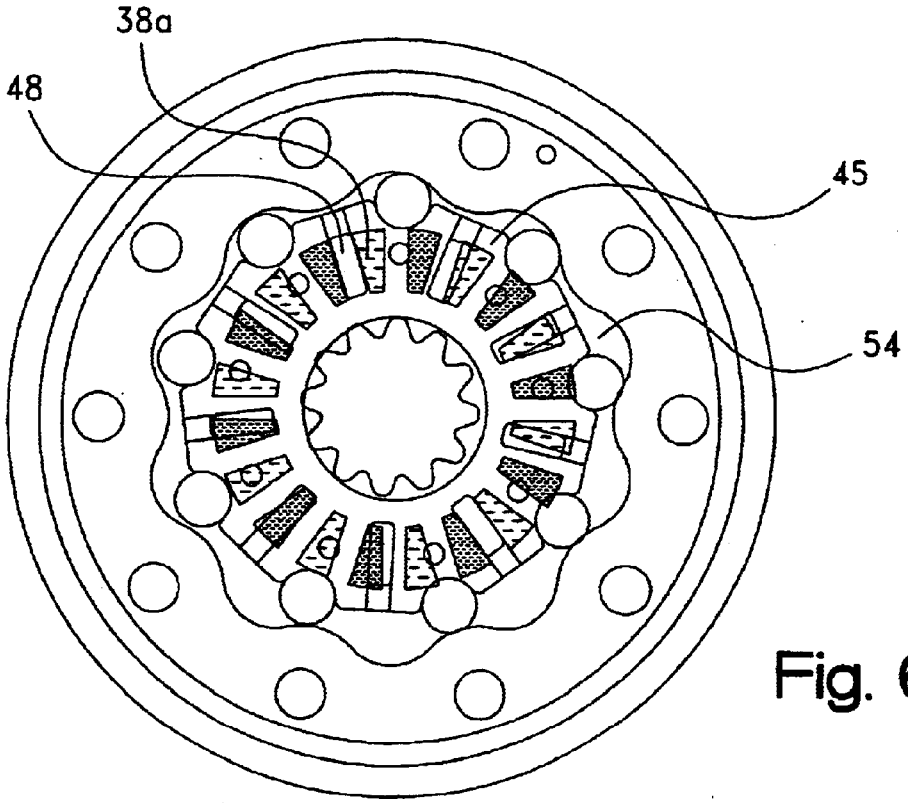

Referring to FIGS. 6*a–c* and 6*a'–c'*, gerotor set 40 has an inherently balanced rotor 45 due to axial passages 48 and through orifices 51. Manifold 32, and specifically manifold plate 33*c*, has twenty aligned openings 34, which are adjacent to gerotor set 40. Aligned openings 34 have alternating pressures, exhaust fluid 38a and high pressure fluid 39*a*, which are valved with rotor axial passages 48 and through orifices 51. Referring to FIG. 6*a*, during operation axial passages 48 on the left side are filled with high pressure fluid 39*a* while axial passages on the right side are filled with exhaust fluid 38*a*. Through orifices 51 on the left side are filled with exhaust fluid 38*a* while through orifices on the right side are filled with high pressure fluid 39*a*. Without through orifices 51, rotor 45 would have an imbalance of hydraulic force (half seeing forces from high-pressure fluid 39*a* and the other half seeing forces from exhaust fluid 38*a*). With through orifices 51, these forces are equally distributed throughout the circumference of rotor 45. Forces on rotor backside 63 are similarly distributed throughout the rotor circumference since axial passages 48 and through orifices 51 extend through rotor 45. If axial passages 48 and through orifices 51 did not extend through to rotor back side 63, the center of hydraulic force at rotor back side 63 would move away from the center of rotor 45 since half of rotor back side 63 would have high pressure fluid 39*a* acting upon it (from volume chambers 54 which axial extend from gerotor set front side 40*a* to gerotor set back side 40*b*) and the other half would have exhaust fluid 38*a* acting upon it. This significant offset of hydraulic force would tip rotor 45 and cause excessive mechanical loading on rotor gear teeth 46, thus creating excessive frictional loss. Once rotor 45 is tipped, it is no longer balanced. Adding high pressure filled flower shaped recess 64 to rotor back side 63 does not change the balance of rotor 45 since this high pressure force has a center that matches rotor 45 center.

Referring to FIGS. 4*b* and 9, when fluid 38 enters axial passage 48 and through orifice 51 in rotor 45, it continues to flow to rotor back side 63 and fills axial passage recess 48*a* and through-orifice recess 51*a*. As previously discussed, filling of recesses 48a and 51a with fluid reduces the viscous friction between rotating rotor 45 and channeling plate 90. Fluid that flows through axial passage 48 and through-orifice 51 during the routine valving process will fill recesses 48*a* and 51*a* thus reducing the friction therebetween. Friction is also reduced due to the reduction of the outer surface area of rotor backside surface 63 via recesses 48*a* and 51*a*. Reduction of friction not only improves the overall efficiency of rotary fluid pressure device 10 but also improves its longevity. The inclusion of recesses 48*a* and 51*a* on rotor back side 63 also reduces the area of transition pressure. Recesses 48*a* and 51*a* will be filled with either pressurized fluid or exhaust fluid. By maximizing, with the recesses, the area that is receiving a flowing, working fluid (the pressurized or exhaust fluid), the area that is not seeing the flowing, working fluid is minimized. The area not seeing working fluid is the transition area between recesses 48*a* and 51*a*.

When rotor 45 rotates, valving is accomplished at the flat, transverse interface of rotor front side 58 and the adjacent side of manifold plate 33*c*. This valving action communicates pressurized fluid 38 to volume chambers 54, causing the chambers to expand, and communicates exhaust fluid from the contracting volume chambers via radial fluid channels 47 and axial passages 48 in rotor 45. FIGS. 6*a–c* and 6*a'–c'* demonstrate the correctness of timely valving when rotor 45 is located at three different angular positions, 0°, 18° (counter-clockwise), and 36° (,counter-clockwise). Since the valving is integrated into rotor 45, there is no timing error resulting from extra drivetrain components which have been eliminated here. In prior art designs, separate componentry, e.g. conventional disk valve assemblies, is needed for valving and the possibilities for cogging, or clocking, are much greater. A conventional disc assembly usually consists of a rotary disk valve driven by a drive link, a stationary manifold, and a pressure compensation device to close off the clearance of the valve interface at high pressure. By eliminating the separate disk valve assembly, the timing error is minimized which in turn improves the low speed performance of hydraulic motor 10.

FIGS. 6*a–c* show rotor 45 rotating, and orbiting, within stator 41. High pressure fluid is shown with a darker, denser, shading. Exhaust fluid is indicated by a lighter, less dense, shading. FIGS. 6*a'–c'* show gerotor set 40 over (or transposed onto) manifold 32, and specifically manifold plate 33*c*, with only the fluid inside manifold plate 33*c* having the shading. In this fashion, the positions of axial passages 48 and through orifices 51 relative to aligned openings 34 in manifold plate 33*c* are clearly shown.

Referring to FIGS. 6*a* and 6*a'*, fluid denominated by numeral 39*a* in alternating aligned manifold plate openings 34 (FIG. 5*c*), indicates high pressure fluid and fluid denominated by 38*a*, in alternate manifold plate openings 34, indicates exhaust fluid. With rotor 45 rotating in a counter-clockwise direction within stator 41, volume chambers 54, extending (counter-clockwise) from the 12 o'clock to the 7 o'clock position (or those filled with high pressure fluid 39*a*), are expanding and volume chambers 54, extending (counter-clockwise) from the 5 o'clock to 12 o'clock position (or those filled with exhaust fluid 38*a*), are contracting. The volume chamber at the 6 o'clock position is in transition from expansion to contraction. As can be seen, each rotor axial passage 48 in the expanding region is axially aligned with a high pressure 39*a* manifold plate opening 34. Each rotor axial passage 48 in the contracting region is axially aligned with an exhaust fluid 38*a* manifold plate opening 34. At the six o'clock position, rotor axial passage 48 is intermediate the high-pressure fluid 39*a* and exhaust fluid 38*a* manifold openings.

In FIGS. 6*b* and 6*b'* rotor 45 has rotated counter-clockwise 18° within stator 41. Volume chambers 54 which are expanding are located (in a counter-clockwise fashion) from the 4 o'clock to the 11 o'clock position. Volume chambers 54 which are contracting are located (counter-clockwise) from the 11 o'clock to the 6 o'clock position. Volume chamber 54 located at the 5 o'clock position is in transition from contraction to expansion. As can be seen, volume chambers 54 which are contracting have axial passages 48 aligned with exhaust fluid 38*a* and volume chambers 54 which are expanding have axial passages 48 aligned with pressurized fluid 39*a*.

In FIGS. 6*c* and 6*c'* rotor 45 has rotated counter-clockwise 36° within stator 41. Volume chambers 54 from the 10 o'clock to the 6 o'clock position (counter-clockwise) are expanding and volume chambers 54 from the 4 o'clock to the 11 o'clock position (counter-clockwise) are contracting. Volume chamber 54 located at the 5 o'clock position is in transition. Volume chambers 54 which are expanding have axial passages 48 aligned with pressurized fluid 39*a* and volume chambers 54 which are contracting have axial passages 48 aligned with exhaust fluid 38*a*.

Illustrating the operation of gerotor set 40 from another perspective, the movement of rotor 45 relative to a stator internal gear tooth 42 situated at 11 o'clock will now be discussed. Referring to FIG. 6*a*, volume chamber 54 (at 11 o'clock) is expanding as it is filled with high-pressure fluid 39*a*. As seen in FIG. 6*a'*, axial passage 48 is in partial axial alignment with opening 34 (which is filled with pressurized fluid 39*a*) in manifold plate 33*c*. As rotor 45 rotates 18° counter-clockwise to the position shown in FIG. 6*b*, rotor gear tooth 46 is in adjacent contact with stator internal gear tooth 42. As seen in FIG. 6*b'*, axial passages 48 are located at 12 o'clock, in axial alignment with opening 34 filled with pressurized fluid 39*a*, and 10 o'clock, in axial alignment with opening 34 for receiving exhaust fluid 38*a*. As rotor 45 rotates 36° counter-clockwise to the position shown in FIGS. 6*c* and 6*c'*, the 11 o'clock volume chamber 54 is contracting as fluid flows from volume chamber 54 through fluid channel 47 (as best shown in FIG. 4*b*), through axial passage 48 and into axially aligned opening 34 in manifold plate 33*c*. Axial passage 48 is in partial axial alignment with opening 34 for exhaust fluid 38*a* in manifold plate 33*c*.

Referring back to FIG. 2, prior art designs typically have a wear plate located between shaft housing 13 and gerotor set 40 that absorbs any axial stresses caused by moving components. A wear plate can be replaced more readily than other componentry and ensures that the other componentry is not negatively affected by axial stresses. But the wear plate also provides another leak path at its connection with adjacent components. In the present invention, the wear plate has been eliminated. Manifold 32, in addition to its manifold function, also serves as a wear plate between shaft housing 13 and gerotor set 40. The elimination of a conventional wear plate reduces the number of parts for hydraulic motor 10 and also eliminates another possible leak path.

Referring to FIG. 3*a*, since rotor 45 has nine gear teeth 46 and stator 41 has ten gear teeth 42, nine orbits of rotor 45 result in one complete rotation thereof and one complete rotation of coupling shaft 20 (FIG. 2). Thus, a 1:9 ratio of gear reduction is achieved. A 1:9 gear reduction along with gerotor set's 40 smooth rotor 45 profile significantly improves the low speed performance of hydraulic motor 10. Similar motors have gear reduction ratios of 1:6 (for 6×7 EGR motors) or 1:8 (for 8×9 EGR motors).

The fluid displacement capacity of hydraulic motor 10 is proportional to the multiple of N (number of rotor external gear teeth), N+1 (number of stator internal gear teeth), and the volume change of each volume chamber 54 of gerotor set 40. The change of volume of each volume chamber 54 is approximately proportional to the eccentricity of gerotor set 40 if the value of N is fixed. The present invention, which uses a 9×10 gerotor set 40 (9 rotor gear teeth 46 and 10 stator gear teeth 42) has similar displacement capacity and overall size as a conventional 6×7 EGR gerotor set while its eccentricity is only one half of that of the 6×7 gerotor set. This 50% reduction of eccentricity significantly reduces the wobble angle of drive link 25 (which is used for operatively connecting rotor 45 and coupling shaft 20). Therefore, the splines of each end of drive link 25 do not need to be heavily crowned. The internal and external spline contact areas between drive link 25, rotor 45 and coupling shaft 20 have a much larger contact area than that of a conventional 6×7 EGR gerotor set. Usually the life of gerotor set orbit motors is limited by the life of drive link 25. The increase of spline contact area improves the torque capacity of drive link 25 and makes rotary fluid pressure device 10 more reliable when it is operated under high torque load.

Referring to FIG. 7*c*, when high pressure fluid fills recess 96, fluid between end cover 70 and channeling plate 90 migrates into bolt holes 81, classifying this motor as a "wet-bolt" type. It should be noted that regardless of the direction of rotation of compact hydraulic motor 10 (or the direction of fluid flow), high pressure fluid will fill bolt holes 81 since in both flow directions recess 96 will be filled with high pressure fluid. Therefore, it is necessary that seal 67 (FIG. 2) is placed radially outside of bolt holes 81 (into seal cavity 97) and that bolt holes 81 avoid first and second ports 15, 16 respectively. Since ports 15, 16 could either be at high or low pressure and the pressure within bolt holes 81 is only high pressure, it is necessary that the high pressure fluid within bolt holes 81 does not interconnect with a low pressure exhaust port. The use of a "wet-bolt" design in a motor is another way to reduce its size and weight.

Leakage in hydraulic motors occurs at locations where components are connected or abut and is generally referred to as cross-port leakage. The present invention significantly reduces cross-port leakage by eliminating componentry. Specifically, since the valving operation is integrated into rotor 45, hydraulic motor 10 has eliminated possible areas, e.g. the disk valve assembly, for cross-port leakage. In the prior art, in order to prevent leakage, designs have used tight fitting gerotor sets that create high friction and wear, thus negatively affecting the mechanical efficiency of the motor. In the present invention, the integration of parts has also eliminated extra mechanical friction between componentry which in turn increases the mechanical efficiency of hydraulic motor 10.

Referring to FIGS. 3*a* and 4*b*, it should be noted that the present invention has an exceptionally high volumetric efficiency since rotor gear teeth 46 can compensate for any wear between the outer surface of rotor 45 and the inner surface of stator 41. Over the operating lifespan of hydraulic motor 10, the conjugation of rotor 45 and stator 41 will cause wearing to each surface. Typically this would create a leak path. Since each rotor gear roller 46 can move radially outwardly, relative to its pocket 53, it can provide a reliable seal between adjacent volume chambers 54. Otherwise fluid could leak from one volume chamber, at the roller/stator interface, to an adjacent volume chamber and fluid would not be discharged through radial fluid channel 47 as intended.

Hydraulic motors can be classified as either having a two-pressure zone or a three-pressure zone. One skilled in the art will appreciate that this invention is applicable to both two and three-pressure zone motors. One skilled in the art will further appreciate that fluid pressure device 10 can be used as either a bi-directional hydraulic pump or motor. When used as a pump, coupling shaft 20 of course acts as an input or driving member in contrast to acting as the output or driven shaft in a motor.

It should be noted that while the valve in rotor feature of the present invention is specifically applicable to an IGR-Type gerotor set, the features pertaining to the inherently balanced rotor 45, the reduced sized manifold set 32, and channeling plate 90 are not limited to an IGR-Type gerotor set, and could be utilized, for example, with an EGR-Type gerotor set.

Figure 10:
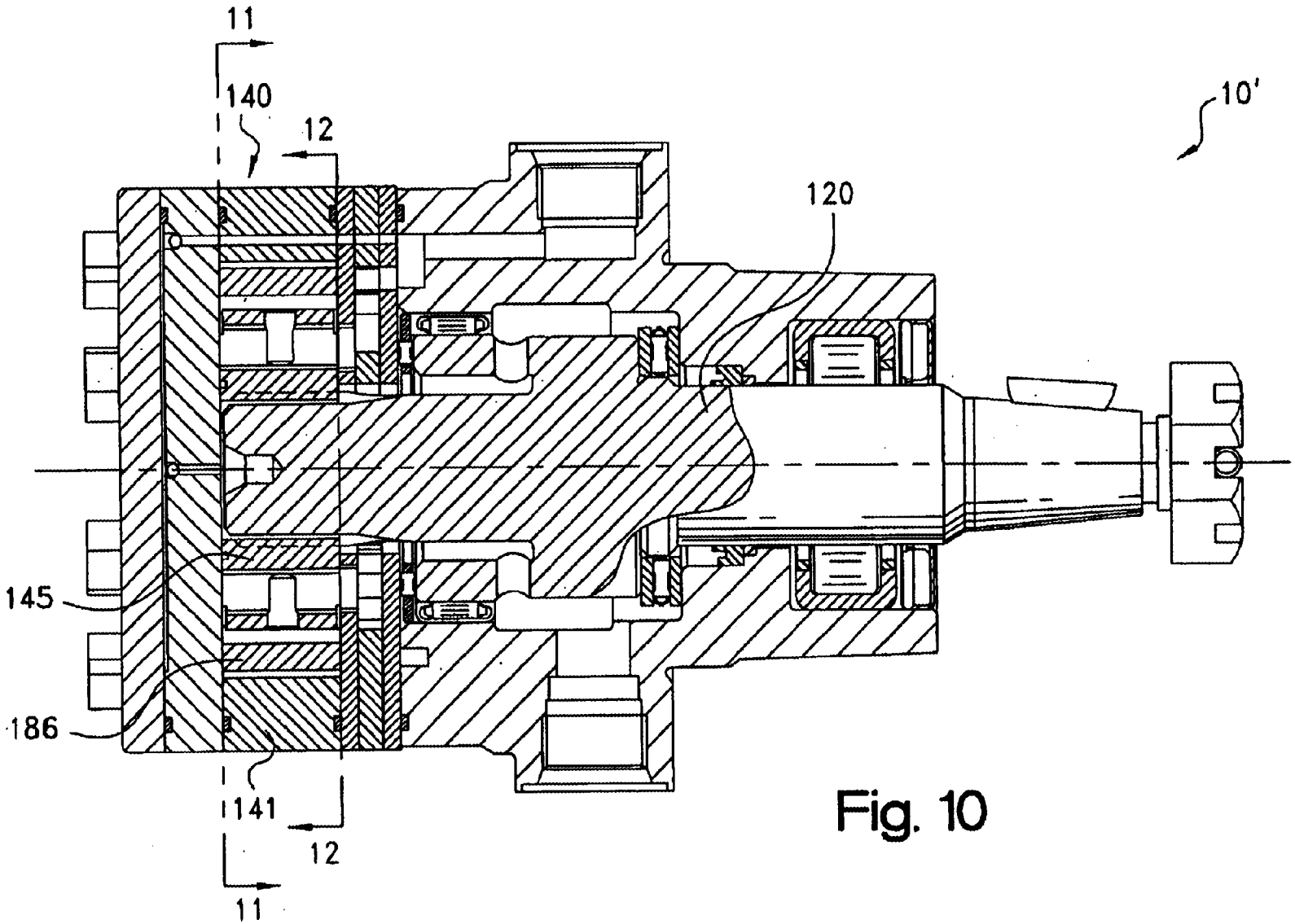
FIG. 10 is a further embodiment of the present invention, showing a sectional view of the hydraulic motor.
Figure 11:
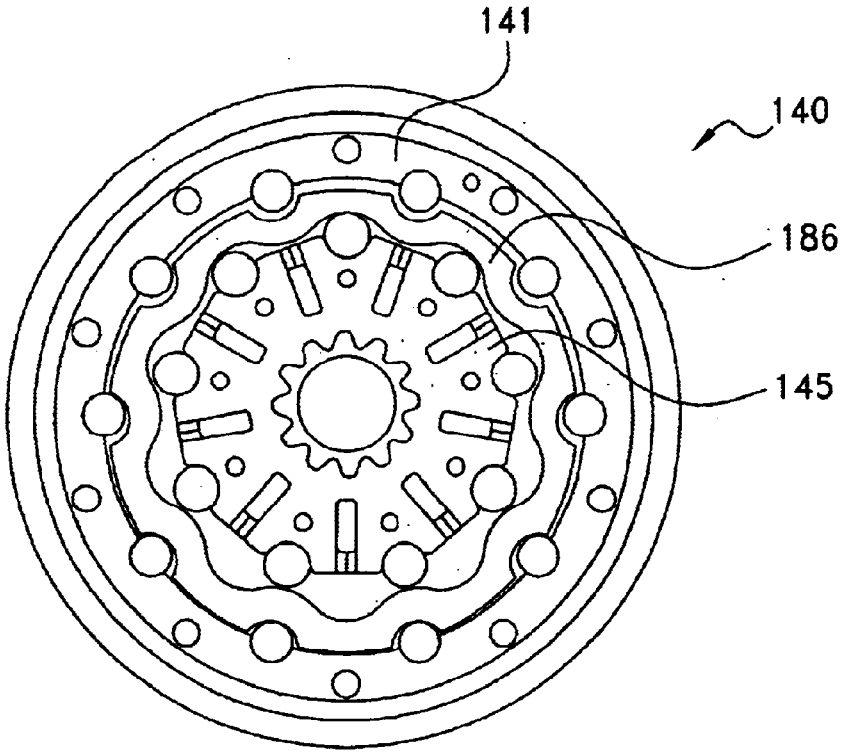
FIG. 11 shows a cross-sectional view of a gerotor of the further embodiment, shown from a first axial end.
Figure 12:
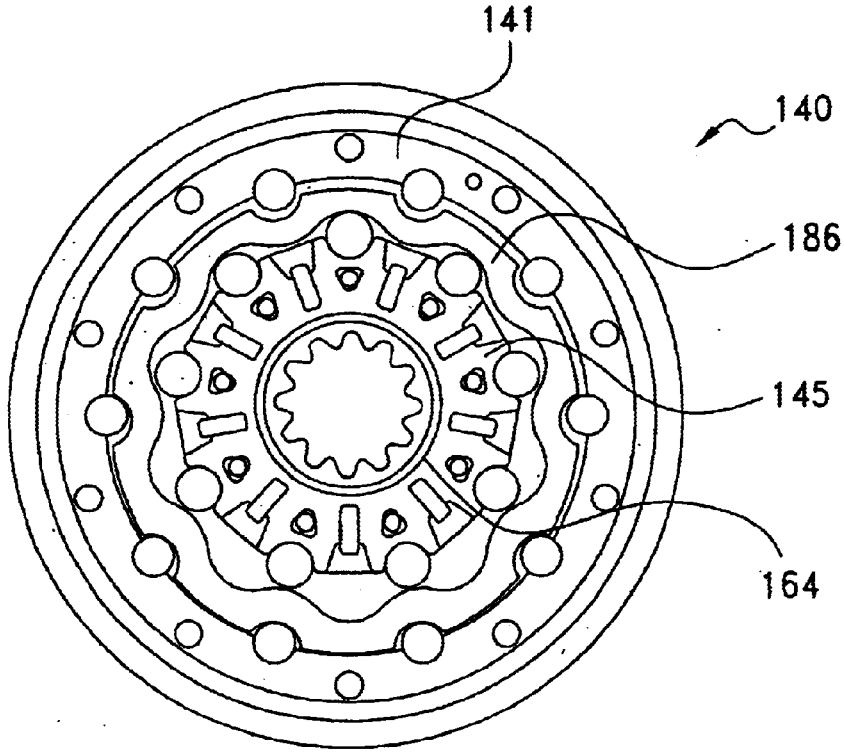
FIG. 12 shows a cross-sectional view of the gerotor of the further embodiment, similar to FIG. 11, but shown from the opposite axial end.

Referring to FIGS. 10–12, a further embodiment 10' of the present invention is shown. In this embodiment the componentry shown in FIG. 2 for hydraulic motor 10 remains the same with the exception of coupling shaft 20, drive link 25, and gerotor set 40. Coupling shaft 20 and drive link 25 (in FIG. 2) have been replaced with a straight, or through, shaft 120. Two-piece gerotor set 40 (comprised of rotor 45 and stator 41) has been replaced with a three-piece gerotor set 140, which now includes a rotor 145, and inner orbiting stator 186, and a fixed outer stator 141. Straight shaft 120 is now directly connected with rotor 145 since rotor 145 only rotates, rather than rotating and orbiting as in prior embodiment 10. Since rotor 145 only rotates, a circular recess 164 is provided to receive high pressure fluid rather than convoluted recess 64 in prior embodiment 10. Outer stator 141 functions similarly to stator 41 in prior embodiment 10. Orbiting inner stator 186 is added to gerotor set 140 and moves in a hypocycloidal fashion, similar to rotor 45 in prior embodiment 10.

Straight shaft 120 gerotor sets similar to this embodiment 10' are well known in the art. An example of a commercially available straight shaft hydraulic motor having a three-piece gerotor set similar to embodiment 10' of the present invention is fully shown and described in U.S. Pat. No. 4,563,136 to Gervais et al., as well as also being assigned to the assignee of the present invention.

As stated above, all other componentry of this embodiment is the same as that shown in embodiment 10. All inventive features, shown and described with reference to embodiment 10 are also present in embodiment 10'. Since embodiment 10' has straight shaft 120, three-piece gerotor set 140 is used in order for inner stator 186 to compensate for the orbiting movement within gerotor set 140.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention as set forth in the appended claims.

What is claimed is:

1. A rotary fluid pressure device comprising:

a housing member defining a fluid inlet port, a fluid outlet port, a first flow passage, a second flow passage and an internal bore;

a manifold assembly having a first fluid passage, a second fluid passage, and an internal bore, one side of said manifold assembly adjoining said housing member;

a gerotor set having an internally toothed stator member; and an externally toothed rotor member, disposed within said stator member, said rotor member having an internal bore and a first and a second axial end surfaces, one of said stator and said rotor members having orbital movement relative to the other said member, said rotor member having a rotational movement relative to said stator, with the internal teeth of said stator member and the external teeth of said rotor member interengaging to define a plurality of expanding and contracting volume chambers; a first plurality of circumferentially spaced laterally directed fluid paths in said rotor extending through said rotor for fluid connection with said manifold assembly first and second fluid passages, a branch conduit for each of said first plurality of fluid paths adapted for directly connecting respective ones of said first plurality of laterally-directed fluid paths in said rotor to said volume chambers, with one side of said gerotor set adjoining another side of said manifold assembly; a second plurality of circumferentially spaced, laterally-directed fluid paths extending through said rotor, said second plurality of fluid paths being circumferentially interposed between said first plurality of fluid paths for sequentially channeling fluid between one of said first and second axial end faces;

an end plate, adjoining another side of said gerotor set;

a rotatably journaled torque transfer shaft operatively interconnected to said rotor and extending from within said housing member; and a plurality of coupling members for interconnecting said endplate, said gerotor set, said manifold assembly, and said housing member.

2. The rotary pressure device as in claim 1 wherein said first and second plurality of laterally directed fluid paths are substantially axially directed.

3. The rotary pressure device as in claim 1 wherein said branch conduits are substantially radially directed.

4. The rotary pressure device as in claim 1 wherein said first plurality of laterally directed fluid paths in said rotor is located in said rotor between externally toothed members thereof.

5. The rotary pressure device as in claim 4 wherein said first plurality of laterally directed fluid paths in said rotor is substantially laterally directed between said rotor first and second axial ends.

6. The rotary pressure device as in claim 4 wherein said first plurality of laterally directed fluid paths in said rotor is substantially circumferentially centered between adjacent ones of said rotor externally toothed members thereof.

7. The rotary pressure device as in claim 4 wherein said first plurality of laterally-directed fluid paths in said rotor is substantially laterally centered between said rotor first and second axial ends and are substantially circumferentially centered between adjacent ones of said rotor externally toothed members thereof.

8. The rotary pressure device as in claim 4 wherein said plurality of laterally-directed fluid paths in said rotor is at least one of substantially laterally directed between said rotor first and second axial ends, and are substantially circumferentially centered between adjacent ones of said rotor externally toothed members thereof.

9. The rotary pressure device as in claim 1 wherein said plurality of laterally directed pluralities of first and second fluid paths are circumferentially centered between adjacent ones of externally toothed members thereof.

10. The rotary pressure device as in claim 1 wherein said second plurality of laterally directed fluid paths is circumferentially centered between said first plurality of laterally directed fluid paths.

11. The rotary pressure device as in claim 1 wherein said second plurality of laterally directed fluid paths in said rotor is substantially laterally directed between said rotor first and second axial ends.

12. The rotary pressure device as in claim 1 wherein said second plurality of laterally directed fluid paths in said rotor is substantially radially aligned with adjacent ones of said rotor externally toothed members thereof.

13. The rotary pressure device as in claim 1 wherein said pluralities of first and second laterally-directed fluid paths are substantially parallel.

14. The rotary pressure device as in claim 1 wherein the laterally-directed center lines of said plurality of first and second fluid paths are substantially located on a common circumferentially-directed circle.

15. The rotary pressure device as in claim 1 wherein one of said first and second axial end faces on said rotor has a first plurality of circumferentially spaced recesses located therein, each of said first plurality of recesses in fluid communication with said first plurality of laterally directed fluid paths.

16. The rotary pressure device as in claim 15 wherein said first plurality of circumferentially spaced recesses functions to reduce the surface area of one of said end faces thereby reducing the viscous friction between said one of said end faces and said end plate.

17. The rotary pressure device as in claim 15 wherein the efficiency of said rotor is increased by increasing the surface area of said recesses thus increasing the area of said one of said end faces that receives a flowing fluid.

18. The rotary pressure device as in claim 1 wherein one of said first and second axial end faces on said rotor has a second plurality of circumferentially spaced recesses located thereon, each of said second plurality of recesses in fluid communication with said second plurality of laterally-directed fluid paths.

19. The rotary pressure device as in claim 18 wherein said second plurality of circumferentially spaced recesses receive fluid for reducing the viscous friction between said one of said first and second axial end faces and said end plate.

20. The rotary pressure device as in claim 18 wherein the majority of said recesses receive one of high pressure fluid and exhaust fluid, thus reducing the recesses not receiving one of high pressure fluid and exhaust fluid.

21. The rotary pressure device as in claim 1 wherein said plurality of laterally-directed first and second fluid paths in said rotor extend through said rotor from said first axial end surface to said second axial end surface.

22. The rotary pressure device as in claim 1 wherein said device functions as one of a hydraulic pump and motor.

23. The rotary pressure device as in claim 1 wherein some of said housing member first flow passage, said housing member second flow passage, said manifold assembly first fluid passage, said manifold assembly second fluid passage as well as said pluralities of rotor first and second laterally-directed fluid paths are utilized for both high pressure and exhaust fluid passage.

24. The rotary pressure device as in claim 1 wherein said housing member first flow passage and said manifold assembly first fluid passage are conduits for high pressure fluid, and said housing member second flow passage and said manifold assembly second fluid passage are conduits for exhaust fluid.

25. The rotary pressure device as in claim 1 wherein said housing member second flow passage and said manifold assembly second fluid passage are conduits for high pressure fluid, and said housing member first flow passage and said manifold assembly first fluid passage are conduits for exhaust fluid.

26. A gerotor hydraulic pressure device for use in one of a hydraulic motor and pump having an internally toothed stator member; an externally toothed rotor member, eccentrically disposed within said stator member, and having an internal bore and first and second axial end surfaces; one of said stator and said rotor members having an orbital movement relative to the other said member, said rotor member having a rotational movement relative to said stator, the internal teeth of said stator member and the external teeth of said rotor member interengaging to define a plurality of expanding and contracting volume chambers, a first plurality of laterally-directed fluid paths extending through said rotor; and a plurality of radiating fluid paths in said rotor, each radiating fluid path being connected to both one of said plurality of laterally-directed fluid paths and one of said plurality of volume chambers; a second plurality of laterally-directed fluid paths extending through said rotor, said second plurality of fluid paths being circumferentially interposed between said first plurality of fluid paths for sequentially channeling fluid between one of said first and second axial end faces.

27. In a gerotor hydraulic pressure device for use in one of a hydraulic pump and motor application including:

a. an internally toothed stator member;

b. an externally toothed rotor member, eccentrically disposed within said stator member, having an internal bore and first and second axial end surfaces, with the external teeth thereof being separated by equally circumferentially spaced connecting portions; and c. one of said stator and rotor members having an orbital movement relative to the other said member and said rotor member having at least a rotational movement relative to said stator, with the internal teeth of said stator member and the corresponding external teeth of said rotor member interengaging to define a plurality of repeating expanding and contracting volume chambers, wherein the improvement comprises:

i. a first plurality of substantially laterally-directed fluid paths in said rotor; a plurality of radiating fluid branches in said rotor, each said radiating fluid branches being connected to both respective ones of said first plurality of laterally-directed fluid paths and one of said plurality of volume chambers;

ii. a second plurality of substantially laterally-directed fluid paths extending through said rotor, said second plurality of fluid paths being circumferentially interposed between said first plurality of fluid paths for sequentially channeling fluid between one of said first and second axial end surfaces.

* * * * *